US009207600B2

(12) United States Patent
Chikugo

(10) Patent No.: US 9,207,600 B2
(45) **Date of Patent: *Dec. 8, 2015**

(54) FIXING APPARATUS

(71) Applicant: CANON KABUSHIKI KAISHA, Tokyo (JP)

(72) Inventor: Youichi Chikugo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/834,601

(22) Filed: Mar. 15, 2013

(65) Prior Publication Data

US 2013/0266353 A1 Oct. 10, 2013

(30) Foreign Application Priority Data

Apr. 6, 2012 (JP) ..... 2012-087253

(51) Int. Cl.
*G03G 15/20* (2006.01)

(52) U.S. Cl.
CPC ..... *G03G 15/2064* (2013.01)

(58) Field of Classification Search
CPC ..... G03G 2215/2016; G03G 15/2053; G03G 2215/2032; G03G 15/2078; G03G 15/2064; G03G 2215/2035; G03G 15/2057; G03G 15/2028; G03G 2215/2022; G03G 2215/1695; G03G 2215/2029
See application file for complete search history.

(56) References Cited

U.S. PATENT DOCUMENTS

| | | | | |
|---|---|---|---|---|
| 7,761,045 | B2 | 7/2010 | Fujimori et al. | |
| 2002/0118982 | A1 | 8/2002 | Fuma | |
| 2013/0266349 | A1 * | 10/2013 | Yoshimura | 399/320 |

FOREIGN PATENT DOCUMENTS

| | | | |
|---|---|---|---|
| JP | 2008-040363 | A | 2/2008 |
| JP | 2010-107659 | A | 5/2010 |

OTHER PUBLICATIONS

U.S. Appl. No. 13/834,122, filed Mar. 15, 2013, Yuichi Makino.

* cited by examiner

*Primary Examiner* — Roy Y Yi
(74) *Attorney, Agent, or Firm* — Canon USA Inc. IP Division

(57) ABSTRACT

A relationship X<Y≤Z is satisfied, where X is a width of a roughening roller in a longitudinal direction, Y is a width, in the longitudinal direction, of an area where an image is able to be formed on a sheet having a maximum width usable in an apparatus, and Z is a width, in the longitudinal direction, of an area where a fixing belt is able to be rubbed by the roughening roller.

20 Claims, 19 Drawing Sheets

· LOWER BELT ASSEMBLY B: PRESSURE POSITION
· ROUGHENING ROLLER 400: SEPARATION POSITION

· LOWER BELT ASSEMBLY B: SEPARATION POSITION
· ROUGHENING ROLLER 400: SEPARATION POSITION

FIG.13

| POSITION OF FIXING BELT 105 | +3.0mm | +1.5mm | -1.5mm | -3.0mm |
|---|---|---|---|---|
| | REAR SIDE | | FRONT SIDE | |
| | STOP APPARATUS | ANGLE CHANGE POSITION | ANGLE CHANGE POSITION | STOP APPARATUS |
| FIRST SENSOR 150a | OFF | ON | OFF | OFF |
| SECOND SENSOR 150b | OFF | ON | ON | OFF |
| ROTATION DIRECTION OF STEPPING MOTOR UPON DETECTION | — | CW | CCW | — |
| ANGLE OF STEERING ROLL | -2 | -2 | 2 | 2 |

FIXING APPARATUS

BACKGROUND OF THE INVENTION

1. Field of the Invention

The present disclosure relates to a fixing apparatus capable of fixing a toner image on a sheet. The fixing apparatus can be used, for example, in an image forming apparatus such as a copying machine, a printer, a facsimile (FAX), and a multi-function peripheral including a plurality of such functions.

2. Description of the Related Art

An image forming apparatus using an electrophotographic method conventionally includes a fixing apparatus which fixes a toner image formed on a recording material (sheet) at a nip portion between two fixing members (first and second fixing rotatable members). A lot of fusibility-improved toners have recently been developed. With improved fusibility, toner can be uniformly and favorably melted by a fixing apparatus. Accordingly, the fixed toner layer is more uniformly and smoothly formed, so that image glossiness can be improved.

As a result, an image having higher glossiness and higher image quality than heretofore can be formed on a high gloss recording material such as coated paper.

As the fixing apparatus repeats fixing processing, the fixing members tend to be deteriorated in surface properties by edge portions of the recording material (both ends in a direction orthogonal to a conveyance direction of the recording material) as compared to other areas. More specifically, the areas touched by the edge portions of the recording material tend to be roughened in the surface as compared to the other areas. Such uneven surface properties of the fixing members may markedly appear on the fixed image as uneven glossiness of the image.

An apparatus discussed in Japanese Patent Application Laid-Open No. 2008-040363 includes a roughening roller (rubbing rotatable member) which rubs the surface of a fixing member. More specifically, the roughening roller rubs the fixing member to make a deteriorated state (surface roughness) of areas touched by edge portions of recording materials less noticeable as compared to the other areas.

On the other hand, if the fixing member is an endless fixing belt, a configuration that causes the fixing belt to reciprocate in a longitudinal direction within a predetermined range is employed in order to prevent the fixing belt from being longitudinally deviation and broken. A configuration that causes the fixing member to reciprocate in the longitudinal direction is also known to reduce the above-described deterioration caused by the contact with the edge portions of the recording material.

Employing the configuration that causes the fixing member to reciprocate longitudinally may increase the range of deterioration of the fixing member by the edge portions of the recording material. Therefore, a width (a longitudinal length) of the roughening roller needs to be increased accordingly.

The inventor has found that the following issue may occur if the width of the roughening roller is set to coincide with a range where the fixing member exists as the fixing member reciprocates.

The issue will be described with reference to FIGS. 19A and 19B. FIG. 19A illustrates a relationship between a contact pressure of a roughening roller with a fixing member and a surface roughness of the fixing member. To maintain the surface roughness of the fixing member within a target range "a" of the surface roughness, at least a contact pressure "b" is needed. The roughening roller is configured to press both longitudinal direction ends of its shaft portions toward the fixing member. Thus, the increased width of the roughening roller causes more than a negligible level of warpage of the roughening roller. As a result, a pressure drop occurs within the range for the roughening roller to rub, or near the center of the longitudinal direction in particular.

FIG. 19B illustrates a relationship between a position in the longitudinal direction and the contact pressure in the rubbing area of the fixing member by the roughening roller. If the contact pressure "b" is secured near the center of the longitudinal direction where the contact pressure is lowest, the contact pressure becomes excessively high at both ends of the rubbing area of the fixing member. Such an excessive contact pressure applies an excessive load to the corresponding areas of the fixing member. Repetition of the rubbing processing may cause cracking or creases in the fixing member.

SUMMARY OF THE INVENTION

The present disclosure is directed to a fixing apparatus that can appropriately rub a first fixing rotatable member with a rubbing rotatable member even in a configuration that causes the first fixing rotatable member to reciprocate.

Further, the present disclosure is directed to a fixing apparatus that can suppress the occurrence of uneven glossiness of an image even in the configuration that causes the first fixing rotatable member to reciprocate.

According to an aspect disclosed herein, a fixing apparatus includes first and second fixing rotatable members configured to fix a toner image on a sheet at a nip portion therebetween, a rubbing rotatable member configured to rub the first fixing rotatable member, and a moving mechanism configured to cause the first fixing rotatable member to reciprocate with respect to a sheet passage area in a longitudinal direction of the first fixing rotatable member, wherein a relationship $X<Y\leq Z$ is satisfied, where X is a width of the rubbing rotatable member in the longitudinal direction, Y is a width, in the longitudinal direction, of an area where an image is able to be formed on a sheet having a maximum width usable in the fixing apparatus, and Z is a width, in the longitudinal direction, of an area where the first fixing rotatable member is able to be rubbed by the rubbing rotatable member as the first fixing rotatable member reciprocates.

According to another aspect disclosed herein, a fixing apparatus includes an endless belt configured to heat a toner image on a sheet at a nip portion, a nip forming member configured to form the nip portion cooperatively with the endless belt, a rubbing rotatable member configured to rub the endless belt, a detector configured to detect a position of the endless belt in a longitudinal direction, and a moving mechanism configured to cause the endless belt to reciprocate in the longitudinal direction according to an output of the detector, wherein a relationship $X<Y\leq Z$ is satisfied, where X is a width of the rubbing rotatable member in the longitudinal direction, Y is a width, in the longitudinal direction, of an area where an image is able to be formed on a sheet having a maximum width usable in the fixing apparatus, and Z is a width, in the longitudinal direction, of an area where the endless belt is able to be rubbed by the rubbing rotatable member as the endless belt reciprocates.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the embodiments disclosed herein.

FIG. 13 illustrates belt end positions and flag logic.

DESCRIPTION OF THE EMBODIMENTS

Various exemplary embodiments, features, and aspects of the invention will be described in detail below with reference to the drawings.

Various configurations of the following exemplary embodiments may be replaced with other known configurations without departing from the scope of the concept of the present disclosure unless otherwise specified.

Image Forming Apparatus

Figure 2:
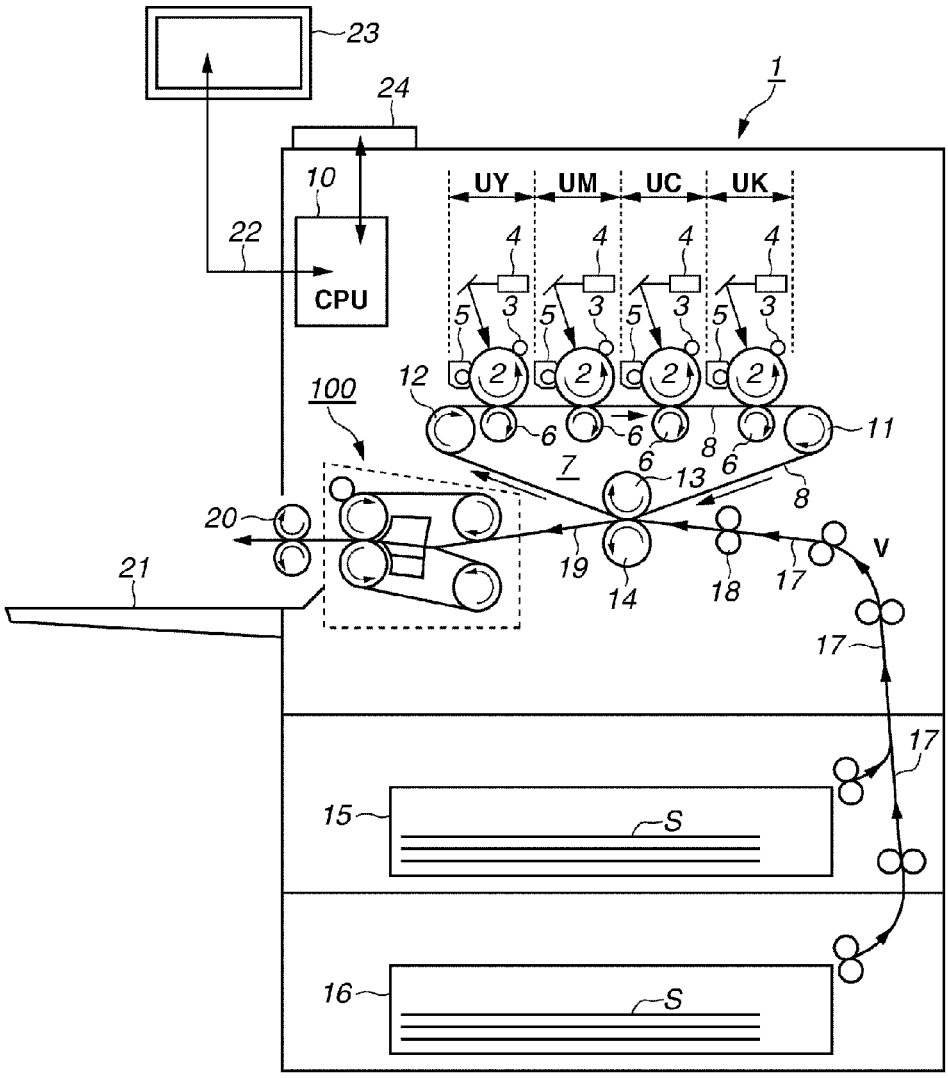
FIG. 2 is a sectional view illustrating an image forming apparatus.

FIG. 2 is a schematic block diagram of an image forming apparatus 1 according to the present exemplary embodiment.

FIG. 2 illustrates a schematic sectional view taken along a conveyance direction V of a recording material (hereinafter, referred to as a sheet) S. The image forming apparatus 1 is a four-color full color electrophotographic printer (hereinafter, referred to as a printer) of an intermediate transfer inline method. The printer 1 can form an image corresponding to image data (electrical image information) input from an external host apparatus 23 on a sheet S and outputs as an image formation product. The external host apparatus 23 is connected to a printer control unit (hereinafter, referred to as a central processing unit (CPU)) 10 via an interface 22.

The CPU 10 is a control unit that controls an operation of the printer 1 in a comprehensive manner. The CPU 10 exchanges various electrical information signals with the external host apparatus 23 and a printer operation unit 24. The CPU 10 further processes electrical information signals input from various process devices and sensors, processes command signals to various process devices, and performs predetermined initial sequence control and predetermined image forming sequence control. Examples of the external host apparatus 23 include a personal computer, a network, an image reader, a facsimile, and the like.

The printer 1 includes first to fourth, four image forming units U (UY, UM, UC, and UK) which are arranged from left to right in FIG. 2. The image forming units UY, UM, UC, and UK are electrophotographic image forming mechanisms having similar configurations, with the only difference in that the developing units 5 contain developers or toners of different colors, namely, yellow (Y), magenta (M), cyan (C), and black (K), respectively.

Each of the image forming unit U includes an electrophotographic photosensitive drum (hereinafter, referred to as a drum) 2, a charging roller 3, a laser scanner 4, a developing unit 5, and a primary transfer roller 6. The drum 2 serves as a first image bearing member. The charging roller 3 serves as a process unit acting on the drum 2.

The respective drums 2 of the image forming units U are driven to rotate in a counterclockwise direction as indicated by arrows at a predetermined speed. A Y color toner image corresponding to a Y color component image of a full color image to be formed is formed on the drum 2 of the first image forming unit UY. An M color toner image corresponding to an M color component image is formed on the drum 2 of the second image forming unit UM. A C color toner image corresponding to a C color component image is formed on the drum 2 of the third image forming unit UC. A K color toner image corresponding to a K color component image is formed on the drum 2 of the fourth image forming unit UK. The toner images are formed on the drums 2 of the image forming units U by known processes and principles. A description thereof will thus be omitted.

An intermediate transfer belt unit 7 is arranged under the image forming units U. The intermediate transfer belt unit 7 includes a flexible endless intermediate transfer belt 8 serving as a second image bearing member. The intermediate transfer belt 8 is wound and stretched around three rollers, including a drive roller 11, a tension roller 12, and a secondary transfer counter roller 13. The drive roller 11 is driven to move the intermediate transfer belt 8 to circulate in a clockwise direction indicated by an arrow at a speed corresponding to the rotation speed of the drums 2. A secondary transfer roller 14 is put into contact with the secondary transfer counter roller 13 by a predetermined pressing force with the intermediate transfer belt 8 therebetween. A contact portion between the intermediate transfer belt 8 and the secondary transfer roller 14 forms a secondary transfer nip portion.

The primary transfer rollers 6 of the respective image forming units U are arranged inside the intermediate transfer belt 8, and make contact with lower surfaces of the respective drums 2 via the intermediate transfer belt 8. In each of the image forming units U, a contact portion between the drum 2 and the belt 8 forms a primary transfer nip portion. A predetermined primary transfer bias is applied to the primary transfer roller 6 at predetermined control timing.

The Y color toner, M color toner, C color toner, and K color toner formed on the drums 2 of the respective image forming units U are primary-transferred to the surface of the moving and circulating intermediate transfer belt 8 at the respective primary transfer nip portions as superimposed in succession. Accordingly, a four-color superimposed and unfixed full color toner image is combined and formed on the intermediate transfer belt 8. The unfixed full color toner image is conveyed to the secondary transfer nip portion.

Meanwhile, one of the sheets S accommodated in a first or second sheet cassette 15 or 16 is separated and fed by an operation of a sheet feeding mechanism and conveyed to a registration roller pair 18 via a conveyance path 17. The registration roller pair 18 once receives the sheet S, and if the sheet S is skewed, makes the sheet S straight in direction. The registration roller pair 18 conveys the sheet S to the secondary transfer nip portion in synchronization with the full color toner image on the intermediate transfer belt 8.

While the sheet S is pinched and conveyed by the secondary transfer nip portion, a predetermined secondary transfer bias is applied to the secondary transfer roller 14. The full color toner image on the intermediate transfer belt 8 is thus secondary-transferred to the sheet S at a time in succession. The sheet S output from the secondary transfer nip portion is separated from the surface of the intermediate transfer belt 8, passes through a conveyance path 19, and is introduced into an image heating fixing apparatus (hereinafter, referred to as fixing apparatus) 100 serving as an image processing apparatus. The fixing apparatus 100 applies heat and pressure to the sheet S to fix the unfixed full color toner image into a fixed image. The sheet S output from the fixing apparatus 100 is conveyed and discharged by a discharge roller pair 20 to a discharge tray 21 as a full color image formation product.

Fixing Apparatus 100

Figure 3:
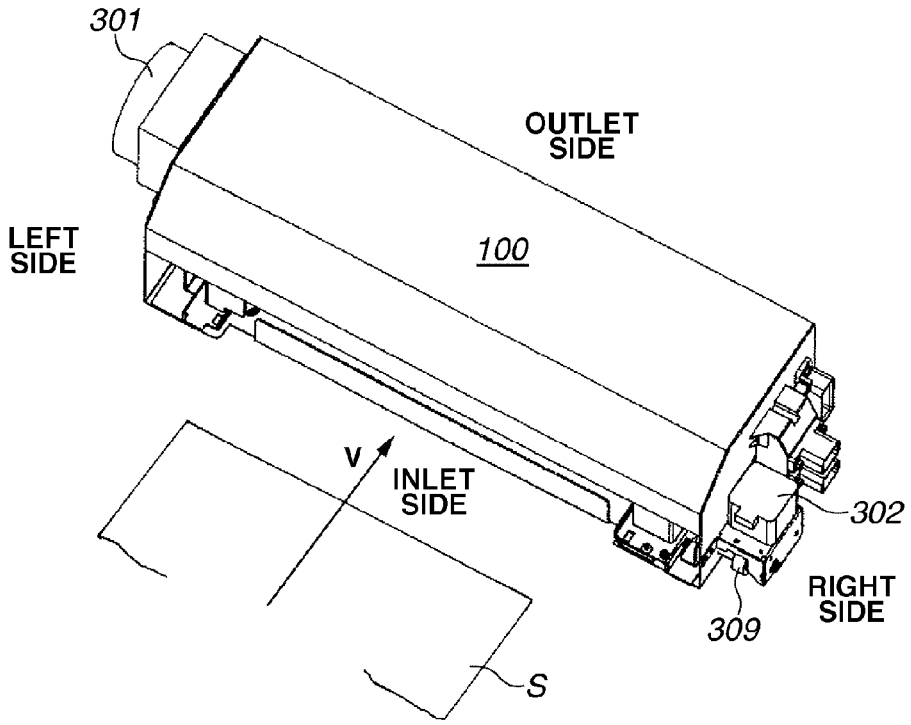
FIG. 3 is a perspective view illustrating an appearance of a fixing apparatus.
Figure 4:
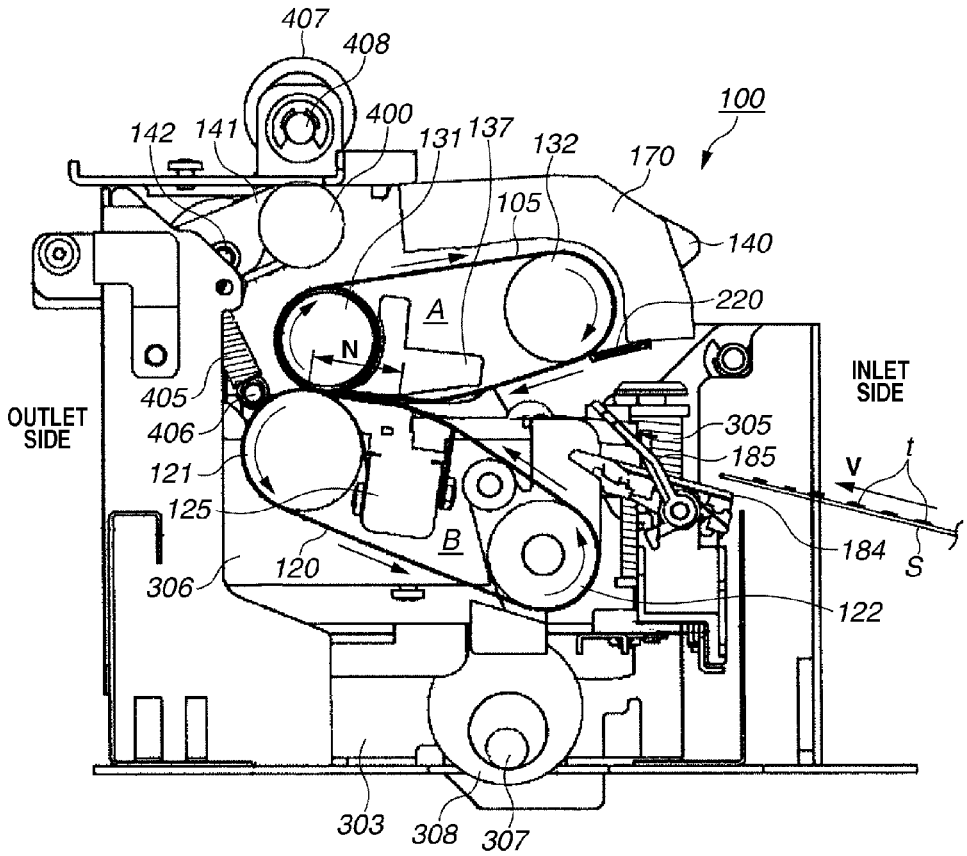
FIG. 4 is a cross-sectional left side view of essential parts of the fixing apparatus (with a lower belt assembly B in a pressure state).
Figure 5:
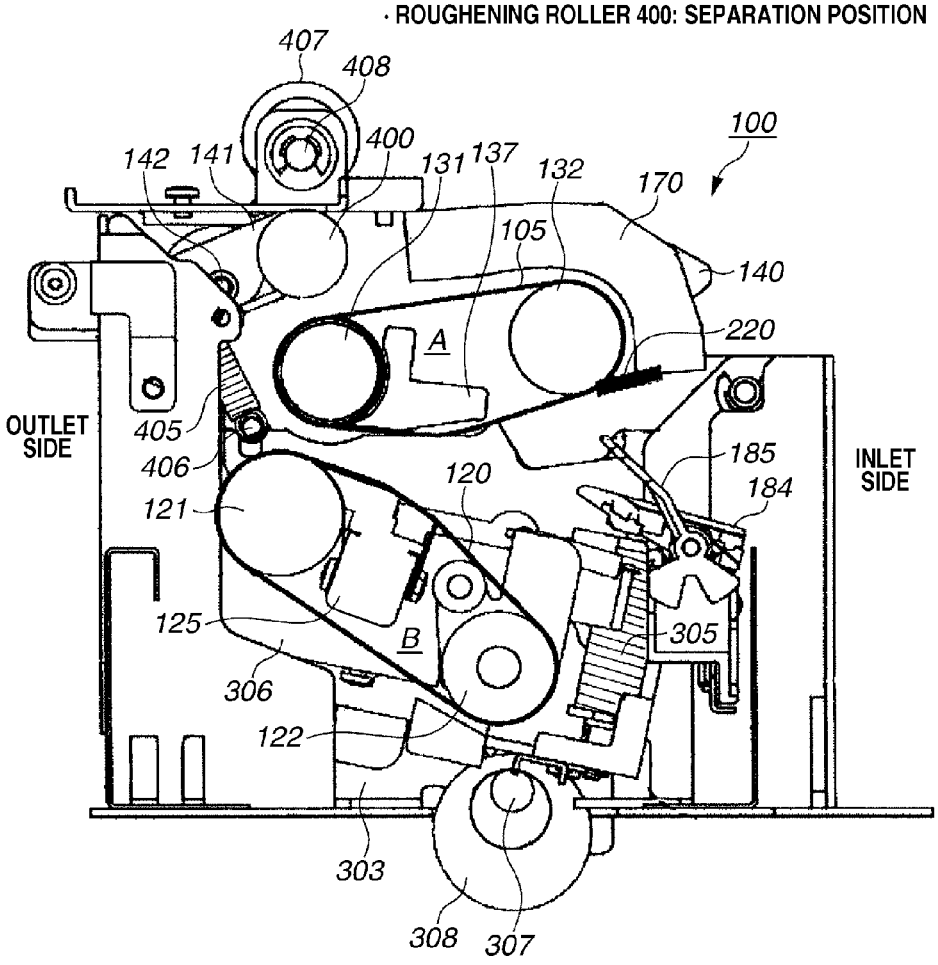
FIG. 5 is a cross-sectional left side view of the essential parts of the fixing apparatus (with the lower belt assembly B in a separated state).
Figure 6:
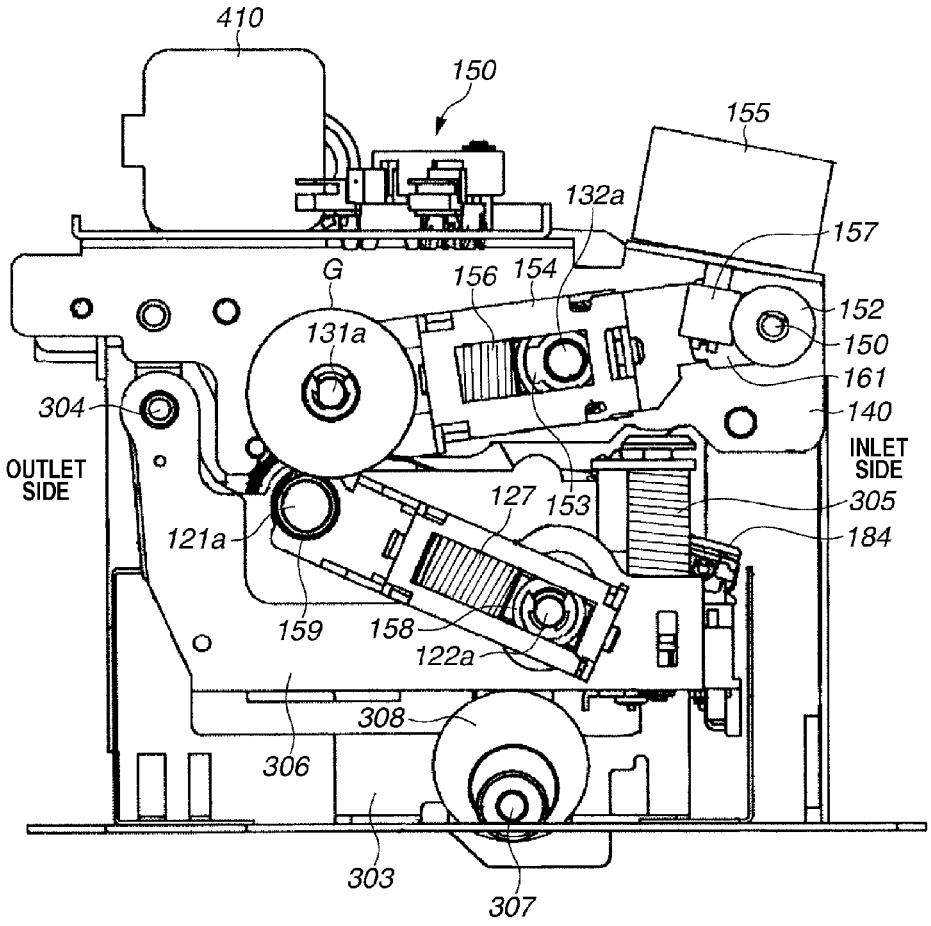
FIG. 6 is a left side view of the essential parts of the fixing apparatus (with the lower belt assembly B in the pressure state).
Figure 7:
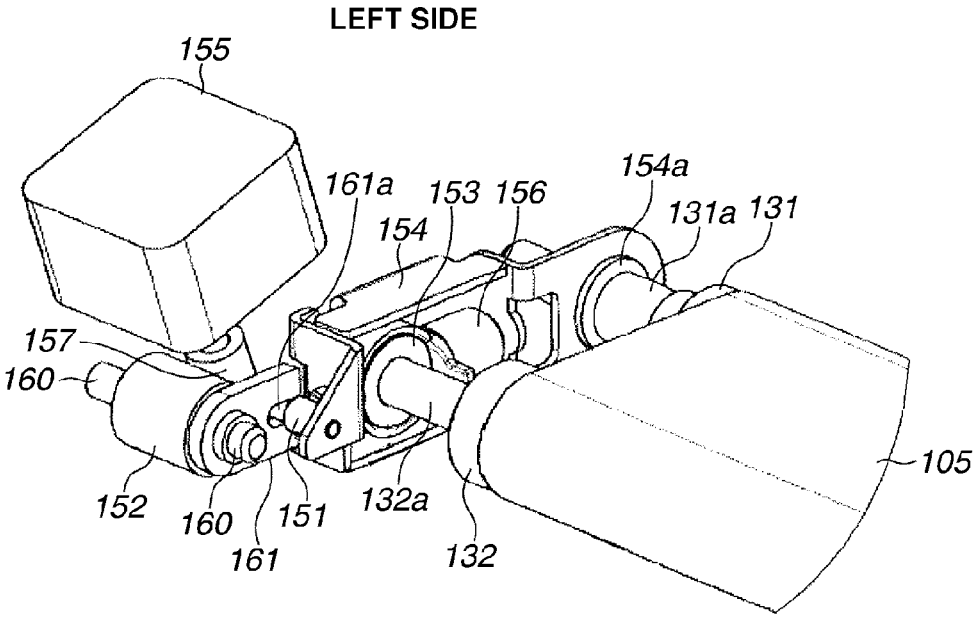
FIG. 7 is a perspective view of a portion of a belt deviation control mechanism.

FIG. 3 is a perspective view illustrating an appearance of the fixing apparatus 100 according to the present exemplary embodiment. FIG. 4 is a cross-sectional left side view of essential parts of the fixing apparatus 100. FIG. 4 illustrates a case where a lower belt assembly B is in a pressure state. FIG. 5 is a cross-sectional left side view of the essential parts of the fixing apparatus 100. FIG. 5 illustrates a case when the lower belt assembly B is in a pressure-released state. FIG. 6 is a left side view of the essential parts of the fixing apparatus 100. FIG. 6 illustrates a case where the lower belt assembly B is in the pressure state. FIG. 7 is a perspective view of a belt deviation control mechanism portion.

Herein, a longitudinal direction or a width direction of the fixing apparatus 100 or a member constituting the fixing apparatus 100 refers to a direction that is parallel to a direction orthogonal to the conveyance direction V of the sheet S in the plane of the sheet conveyance path. That is, the width direction of a fixing belt or the sheet S refers to the direction parallel to the direction orthogonal to the conveyance direction V of the sheet S (the direction parallel to a W direction in FIG. 1). A lateral direction in the plane of the sheet conveyance path refers to a direction parallel to the conveyance direction V of the sheet S.

A front of the fixing apparatus 100 refers to a plane of a sheet inlet side. A back of the fixing apparatus 100 refers to a plane of a sheet outlet side. The right and left refer to the right and left of the fixing apparatus 100 when seen from the front, respectively. According to the present exemplary embodiment, the left side is referred to as a forward side, and the right side a rear side. Above and below refer to above and below in the direction of the gravitational force, respectively. Upstream and downstream refer to upstream and downstream in terms of the conveyance direction V of the sheet S, respectively.

Figure 1:
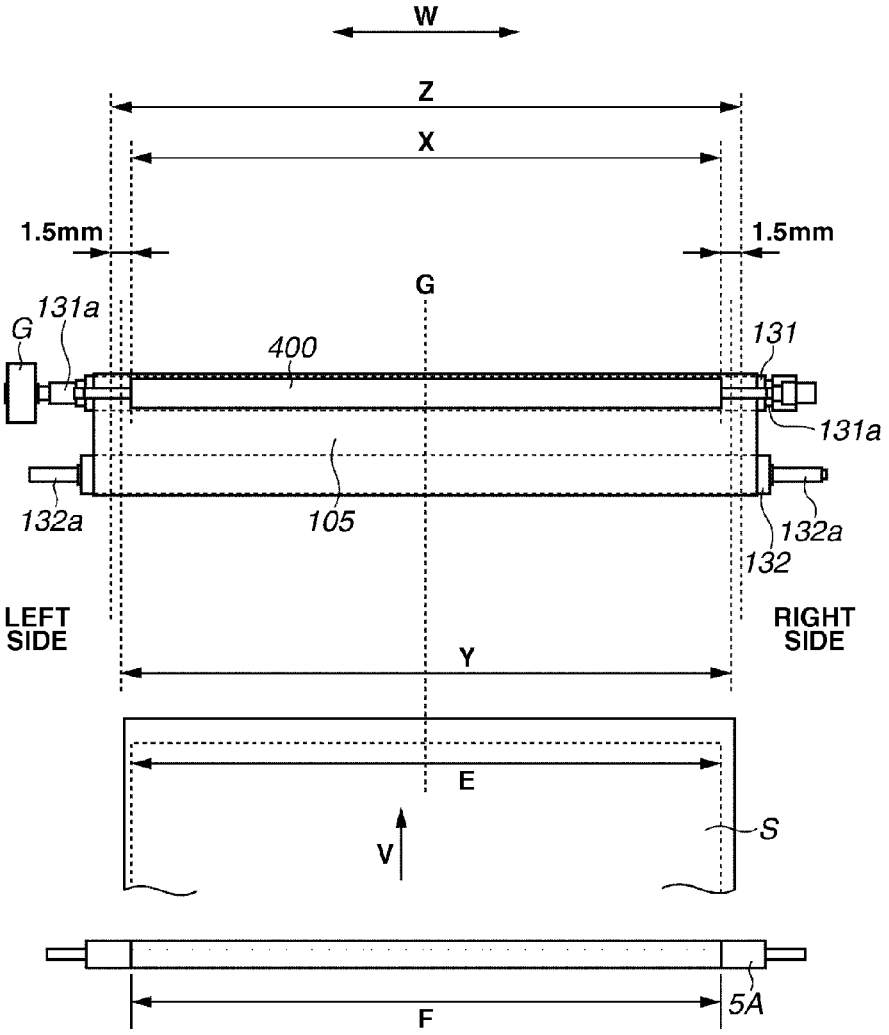
FIG. 1 is a partial view illustrating a positional relationship between a fixing belt and a roughening roller.

As illustrated in FIG. 1, a center of the sheet S in the width direction (the direction (W direction) orthogonal to the conveyance direction V) is referred to as a sheet conveyance reference G (dotted line). In this situation, a roughening member (roughening roller) 400 is arranged so that a center of its effective functioning area (in the case of the roughening member 400, corresponding to an area other than shaft portions) in the longitudinal direction substantially coincides with the sheet conveyance reference G. As will be described below, a fixing belt 105 is configured to reciprocate (swing) in the longitudinal direction (width direction) centering around the sheet conveyance reference G by a deviation control mechanism.

The fixing apparatus 100 serving as an image processing apparatus of the present exemplary embodiment is an image heating apparatus which employs a belt nip method, an electromagnetic induction heating (IH) method, and an oil-less fixing method.

The fixing apparatus 100 is configured to perform fixing processing at a nip portion formed between two fixing rotatable members which are the fixing belt 105 and a pressure belt 120. More specifically, the fixing apparatus 100 includes an upper belt assembly A serving as a heating unit and the lower belt assembly B serving as a pressure unit. The fixing apparatus 100 further includes a pressure-separation mechanism (abutting/separating mechanism) for pressing and separating the lower belt assembly B against/from the upper belt assembly A. The fixing apparatus 100 further includes an IH heater (magnetic flux generation unit) 170, the deviation control mechanism of the fixing belt 105, and a roughening mechanism (surface property recovery mechanism). The IH heater 170 heats the fixing belt 105 of the upper belt assembly A. The roughening mechanism substantially recovers a surface property of the fixing belt 105. These components will be described in order below.

Upper Belt Assembly A and IH Heater 170

The upper belt assembly A is arranged between right and left upper side plates 140 of an apparatus housing. The upper belt assembly A includes a flexible endless fixing belt 105. The fixing belt 105 includes a release layer on its surface and serves as a fixing rotatable member (heating rotatable member, fixing member) facing to an image bearing surface of the sheet S. The upper belt assembly A further includes a drive roll (fixing roll, support roll) 131, a steering roll 132, and a pad stay 137 that serve as a plurality of belt suspension members around which the fixing belt 105 is suspended. The steering roll 132 also serves as a tension roll.

The drive roll 131 is arranged on the sheet outlet side between the right and left upper side plates 140. Right and left shaft portions 131*a* of the drive roll 131 are rotatably supported between the right and left upper side plates 140 via respective bearings (not illustrated).

Steering roll support arms 154 are arranged onside the right and left upper side plates 140, respectively. The steering roll support arms 154 extend from the side of the drive roll 131 to the sheet inlet side. The right steering roll support arm 154 (not illustrated) is fixed to the right upper side plate 140 (not illustrated). Referring to FIG. 7, the left steering roll support arm 154 is supported by the left shaft portion 131*a* of the drive roll 131 via a bearing 154*a*. Thus, the left steering roll support arm 154 is vertically swingable about the left shaft portion 131*a*. A pin 151 is put into a free end of the left steering roll support arm 154. A shaft 160 is put into an outside surface of the left upper side plate 140 on the sheet inlet side.

A fork plate 161 having a U-shaped groove 161*a* is integrally formed on a worm wheel (helical gear) 152, and the worm wheel 152 is rotatably supported by the shaft 160. The pin 151 of the left steering roll support arm 154 is engaged with the groove 161*a* of the fork plate 161. A stepping motor 155 is arranged on the upper side plate 140. A worm 157 fixed to a rotation shaft of the stepping motor 155 meshes with the worm wheel 152.

A forward rotation or reverse rotation of the stepping motor 155 rotates the fork plate 161 upward or downward via the worm 157 and the worm wheel 152. In conjunction with this rotation, the left steering roll support arm 154 rotates upward or downward about the shaft portion 131*a*.

The steering roll 132 is arranged on the sheet inlet side between the right and left upper side plates 140. Right and left shaft portions 132*a* of the steering roll 132 are rotatably supported by the right and left steering roll support arms 154 via respective bearings 153. The bearings 153 are supported by the steering roll support arms 154 slidably and movably in a belt tension direction. Further, the bearings 153 are biased by tension springs 156 to move in a direction away from the drive roll 131.

The pad stay 137 is a member made of stainless steel (SUS material), for example. Both right and left ends of the pad stay 137 are fixed to the right and left upper side plates 140. The pad stay 137 is thus supported inside the fixing belt 105 closer to the drive roll 131 between the drive roll 131 and the steering roll 132, with its pad surface downward.

The fixing belt 105 which is suspended around the drive roll 131, the steering roll 132, and the pad stay 137 is subjected to predetermined tension (tensile force) resulting from the movement of the steering roll 132 in the belt tension direction, caused by the biasing forces of the tension springs 156. According to the present exemplary embodiment, tension of 200 N is applied to the fixing belt 105. An inner surface of a descending belt portion of the fixing belt 105 is put in contact with the downward pad surface of the pad stay 157.

Any fixing belt 105 that can be heated by the IH heater 170 and has heat resistance may be selected as appropriate. For example, a nickel metal layer, stainless steel layer, or other magnetic metal layer having a thickness of 75 μm, a width of 380 mm, and a circumferential length of 200 mm, coated with a 300-μm-thick silicon rubber and covered with a perfluoroalkoxy (PFA) tube as a surface layer (release layer), may be used.

An example of the drive roll 131 is a roll which is formed by integrally molding a solid core of stainless steel having an outer diameter of ϕ18 is with a heat-resistant silicon rubber elastic surface layer. The drive roll 131 is arranged on the sheet outlet side of a nip area of a fixing nip portion N which is formed between the fixing belt 105 and the pressure belt 120 serving as a second fixing rotatable member to be described below. The elastic layer of the drive roll 131 is elastically distorted by a predetermined amount by pressure contact of a pressure roll 121.

According to the present exemplary embodiment, the drive roll 131 and the pressure roll 121 form a nip of generally straight shape with the fixing belt 105 and the pressure belt 120 therebetween. However, the drive roll 131 and the pressure roll 121 may have various crown shapes. For example, the drive roll 131 and the pressure roll 121 may be intentionally configured with a concave crown shape to control buckling of the sheet S ascribable to differences in the speed of the sheet S within the fixing nip portion N.

An example of the steering roll 132 is a hollow roll of stainless steel with an outer diameter of ϕ20 and an inner diameter of ϕ18 or so. The steering roll 132 functions as a tension roller that stretches and tensions the fixing belt 105. The deviation control mechanism to be described below controls a tilt of the steering roll 132, so that the steering roll 132 also functions as a steering roll for adjusting meandering of the fixing belt 105 in the width direction orthogonal to the moving direction of the fixing belt 105.

A drive input gear G is coaxially fixed to and arranged on the left end of the shaft portion 131*a* of the drive roll 131. A drive motor 301 (FIG. 3) inputs a drive to the drive input gear G via a drive transmission unit (not illustrated), so that the drive roll 131 is driven to rotate in the clockwise direction indicated by an arrow in FIG. 4 at a predetermined speed.

The rotation of the drive roll 131 conveys the fixing belt 105 to circulate in the clockwise direction indicated by the arrow in the drawing at a speed corresponding to the speed of the drive roll 131. The steering roll 132 rotates to follow the circulation and conveyance of the fixing belt 105. The inner surface of the descending belt portion of the fixing belt 105 slides and moves over the downward pad surface of the pad stay 137. To stably convey the sheet S at the fixing nip portion N to be described below, the fixing belt 105 and the drive roll 131 reliably transmit the drive therebetween.

The IH heater 170 serves as a heating unit for heating the fixing belt 105. The IH heater 170 is an induction heating coil unit including an excitation coil, a magnetic core, and a holder that holds the excitation coil and the magnetic core. The IH heater 170 is arranged above the upper belt assembly A. The IH heater 170 is fixed to and arranged between the right and left upper side plates 140 so that the IH heater 170 faces the fixing belt 105, or more specifically, an upper surface portion of the fixing belt 105 and a portion of the fixing belt 105 where the steering roll 132 lies, at a predetermined distance without contact.

An alternating current is supplied to the excitation coil of the IH heater 170 to generate an alternating-current magnetic flux. The alternating-current magnetic flux is introduced into the magnetic core to generate eddy currents in the magnetic metal layer of the fixing belt 105 serving as an induction heat generation member. The eddy currents generate Joule heat based on the specific resistance of the induction heat generation member. The alternating current supplied to the excitation coil is controlled so that the surface temperature of the fixing belt 105 is adjusted to approximately 140° C. to 200° C. (target temperature) based on temperature information from a thermistor 220 for detecting a temperature of the surface layer of the fixing belt 105.

Lower Belt Assembly B and Pressure-Separation Mechanism

The lower belt assembly B is arranged under the upper belt assembly A. The lower belt assembly B is installed on a lower frame (pressure frame) 306. The lower frame 306 is vertically rotatably supported about a hinge shaft 304 which is fixed to right and left lower side plates 303 on the sheet outlet side of the fixing apparatus 100.

The lower belt assembly B includes the flexible endless pressure belt 120 serving as a nip forming member (fixing rotatable member, pressure member) which forms the fixing nip portion N with the fixing belt 105 of the upper belt assembly A. The lower belt assembly B further includes the pressure roll (pressure roller) 121, a tension roll 122, and a pressure pad 125 that serve as a plurality of belt suspension members around which the pressure belt 120 is suspended with tension.

Right and left shaft portions 121*a* of the pressure roll 121 are rotatably supported between right and left side plates of the lower frame 306 via bearings 159, respectively. Right and left shaft portions 122*a* of the tension roll 122 are rotatably supported by the right and left side plates of the lower frame 306 via bearings 158, respectively. The bearings 158 are supported by the lower frame 306 slidably and movably in a belt tension direction. The bearings 158 are biased by tension springs 127 to move in a direction away from the pressure roll 121.

An example of the pressure pad 125 is a member made of silicon rubber. Both right and left ends of the pressure pad 125 are fixed to and supported by the right and left side plates of the lower frame 306. The pressure roll 121 is placed on the sheet outlet side between the right and left side plates of the lower frame 306. The tension roll 122 is placed on the sheet inlet side between the right and left side plates of the lower frame 306. The pressure pad 125 is not-rotatably supported and arranged inside the pressure belt 120 closer to the pressure roll 121 between the pressure roll 121 and the tension roll 122, with its pad surface upward.

The pressure belt 120 which is suspended around the pressure roll 121, the tension roll 122, and the pressure pad 125 is subjected to predetermined tension (tensile force) resulting from the movement of the tension roll 122 in the belt tension direction, caused by the biasing forces of the tension spring 127. According to the present exemplary embodiment, a tension of 200 N is applied to the pressure belt 120. An inner surface of an ascending belt portion of the pressure belt 120 is put in contact with the upward pad surface of the pressure pad 125.

Any heat-resistant pressure belt 120 may be selected as appropriate. For example, a nickel metal layer having a thickness of 50 μm, a width of 380 mm, and a circumferential length of 200 mm, coated with a 300-μm-thick silicon rubber and covered with a PFA tube as a surface layer (release layer), may be used. An example of the pressure roll 121 is a solid roll made of stainless steel with an outer diameter of ϕ20. An example of the tension roll 122 is a hollow roll made of stainless steel with an outer diameter of ϕ20 and an inner diameter of ϕ18 or so.

The lower belt assembly B is controlled to rotate vertically about the hinge shaft 304 by the pressure-separation mechanism serving as an abutting/separating unit. More specifically, when the lower belt assembly B is rotated and lifted up by the pressure-separation mechanism, the lower belt assembly B moves to a pressure position as illustrated in FIG. 4. When the lower belt assembly B is rotated and lifted down, the lower belt assembly B moves to a separation position as illustrated in FIG. 5.

When the lower belt assembly B is moved to the pressure position, the pressure roll 121 and the pressure pad 125 are respectively pressed against the drive roll 131 and the pad stay 137 of the upper belt assembly A by a predetermined pressure force with the pressure belt 120 and the fixing belt 105 therebetween. Accordingly, the fixing belt 105 of the upper belt assembly A and the pressure belt 120 of the lower belt assembly B form therebetween the fixing nip portion N having a predetermined width in the conveyance direction V of the sheet S. When the lower belt assembly B is moved to the separation position, the pressure against the upper belt assembly A is released, and the lower belt assembly B is separated from the upper belt assembly A without contact.

The pressure-separation mechanism according to the present exemplary embodiment will be described. A pressure spring unit is arranged on the lower frame 306 at a side opposite from the hinge shaft 304. The pressure spring unit includes a pressure spring 305 for elastically pressing the lower belt assembly B against the upper belt assembly A.

A pressure camshaft 307 is rotatably supported between lower portions of the right and left lower side plates 303 with bearings. A pair of eccentric pressure cams 308 having the same shape and the same phase are fixed to and arranged on the right and left sides of the pressure camshaft 307. The eccentric pressure cams 308 support the bottom surface of the lower frame 306. A pressure gear 309 (FIG. 3) is coaxially fixed to and arranged on the right end of the pressure camshaft 307. A pressure motor 302 inputs a drive to the pressure gear 309 via a drive transmission unit (not illustrated), so that the pressure camshaft 307 is driven to rotate.

The pressure camshaft 307 is controlled to rotate to a first rotation angle position and a second rotation angle position. In the first rotation angle position, the eccentric pressure cam 308 is situated with its large protrusion upward as illustrated in FIGS. 4 and 6. In the second rotation angle position, the eccentric pressure cam 308 is situated with its large protrusion downward as illustrated in FIG. 5.

When the pressure camshaft 307 is rotated to and stopped at the first rotation angle position, the large protrusions of the eccentric pressure cams 308 lift up the lower frame 306 on which the lower belt assembly B is mounted. The lower belt assembly B comes into contact with the upper belt assembly A while compressing the pressure spring 305 of the pressure spring unit. Accordingly, the lower belt assembly B is elastically pressed and biased to the upper belt assembly A by a predetermined pressure (for example, 400 N) resulting from a compression reactive force of the pressure spring 304. The lower belt assembly B is held in the pressure position illustrated in FIG. 4.

The pressure contact of the pressure roll 121 with the drive roll 131 warps and deforms the drive roll 131 by several hundreds of micrometers in a direction opposite from the contacting direction to the pressure roll 121. The warpage and deformation of the drive roll 131 causes a pressure drop in the center of the fixing nip portion N in the longitudinal direction. To avoid the pressure drop, the drive roll 131 or both the drive roll 131 and the pressure roll 121 is/are configured with a crown shape so that the drive roll 131 and the pressure roll 121 form a nip of generally straight shape. According to the present exemplary embodiment, the drive roll 131 has a positive crown shape of 300 μm.

When the pressure camshaft 307 is rotated to and stopped at the second rotation angle position, the large protrusions of the eccentric pressure cams 308 are directed downward and the small protrusions face the bottom surface of the lower frame 306, so that the lower belt assembly B is lifted down. In other words, the lower belt assembly B is held in the separation position illustrated in FIG. 5 where the pressure against the upper belt assembly A is released and the lower belt assembly B is separated from the upper belt assembly A by a predetermined distance without contact.

Figure 8A:
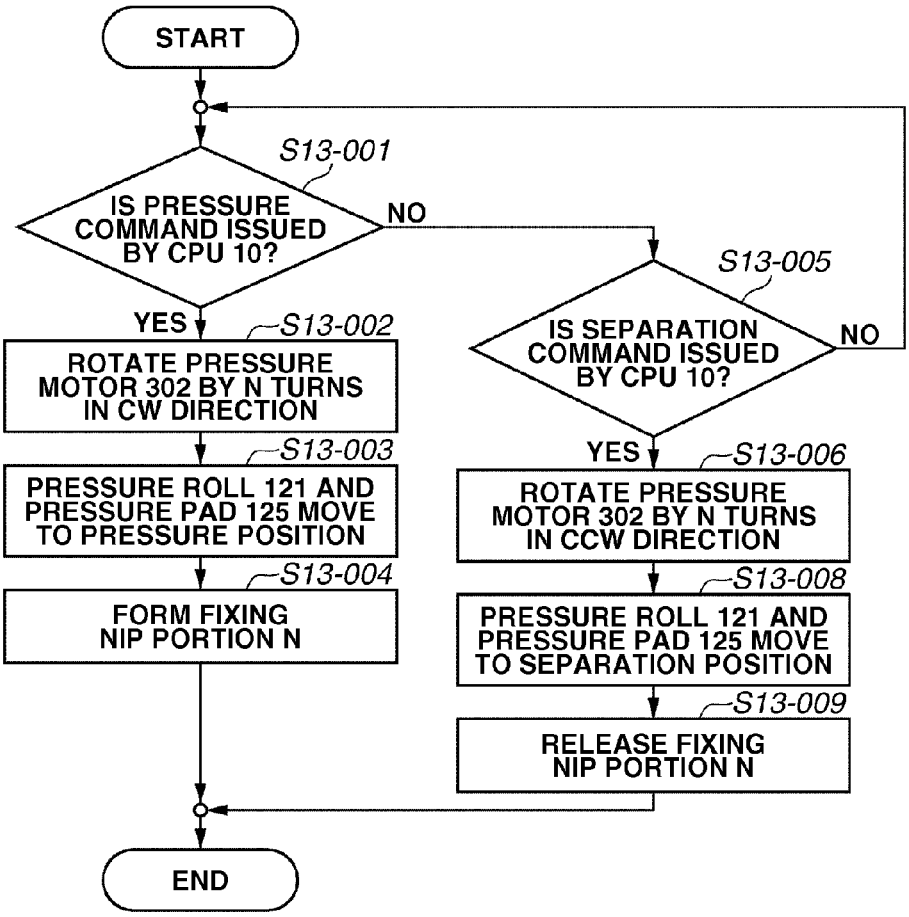
FIG. 8A is a flowchart illustrating vertical movement control of the lower belt assembly B.
Figure 8B:
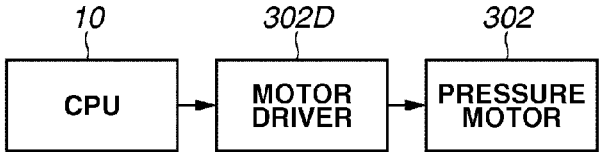
FIG. 8B is a block diagram of a control system.

A vertical movement control of the lower belt assembly B will be described with reference to a control flowchart illustrated in FIG. 8A and a block diagram of a control system illustrated in FIG. 8B.

The lower belt assembly B is normally held at the separation position illustrated in FIG. 5. In step S13-001, if the CPU 10 issues a pressure command (YES in step S13-001), then in step S13-002, the CPU 10 rotates the pressure motor 302 by a predetermined number of rotations, or N turns, in a clockwise (CW) direction via a motor driver 302D. Accordingly, the pressure camshaft 307 is driven to rotate by a half turn. In step S13-003, the eccentric pressure cams 308 are switched from the second rotation angle position illustrated in FIG. 5 to the first rotation angle position illustrated in FIGS. 4 and 6, and the lower belt assembly B is rotated and lifted up so that the pressure roll 121 and the pressure pad 125 move to the pressure position.

More specifically, the pressure roll 121 and the pressure pad 125 are pressed against the drive roll 131 and the pad stay 137 of the upper belt assembly A by a predetermined contact pressure with the pressure belt 120 and the fixing belt 105 therebetween. In step S13-004, the fixing belt 105 and the pressure belt 120 form therebetween the fixing nip portion N having a predetermined width in the sheet conveyance direction V.

In step S13-005, if the lower belt assembly B is held in the pressure position illustrated in FIG. 4 and the CPU 10 issues a separation command (YES in step S13-005), then in step S13-006, the CPU 10 rotates the pressure motor 302 by a predetermined number of rotations, or N turns, in a counterclockwise (CCW) direction via the motor driver 302D. Accordingly, the pressure camshaft 307 is driven to rotate by a half turn. In step S13-008, the eccentric pressure cams 308 are switched from the first rotation angle position illustrated in FIGS. 4 and 6 to the second rotation angle position illustrated in FIG. 5. In other words, the lower belt assembly B is rotated and lifted down, so that the pressure roll 121 and the pressure pad 125 move to the separation position. In step S13-009, thus, the formation of the fixing nip portion N is released.

Fixing Operation and Temperature Adjustment Control

Figure 9A:
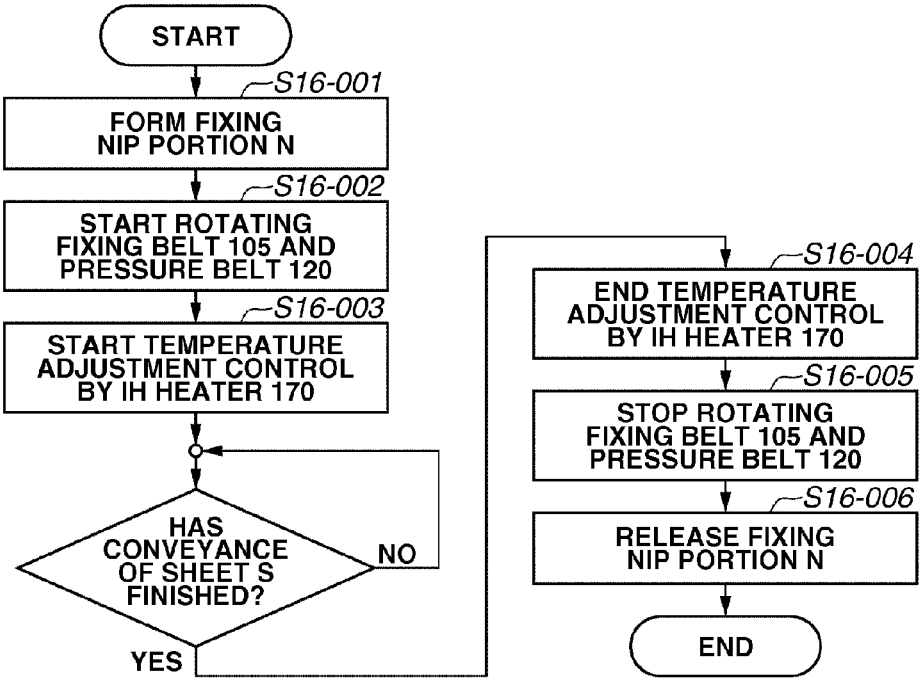
FIG. 9A is a flowchart illustrating fixing operation control of the fixing apparatus.
Figure 9B:
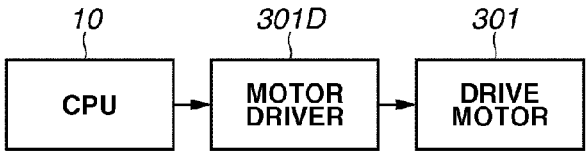
FIG. 9B is a block diagram of a control system.

Next, a fixing operation of the fixing apparatus 100 will be described with reference to a control flowchart illustrated in FIG. 9A and a block diagram of a control system illustrated in FIG. 9B. When the fixing apparatus 100 is in a standby state, the lower belt assembly B is held in the separation position illustrated in FIG. 5. The drive motor 301 stops being driven. Power supply to the IH heater 170 is also stopped.

In step S16-001, the CPU 10 starts a predetermined image forming sequence control based on input of a print job start signal. The CPU 10 drives the pressure motor 302 of the fixing apparatus 100 via the motor driver 302D at predetermined control timing, so that the pressure camshaft 307 is driven to rotate by a half turn. Accordingly, the lower belt assembly B is moved from the separation position illustrated in FIG. 5 to the pressure position illustrated in FIG. 4. The fixing belt 105 and the pressure belt 120 form the fixing nip portion N therebetween.

Next, the CPU 10 drives the drive motor 301 via a motor driver 301D to input a drive to the drive input gear G. Accordingly, the drive roll 131 of the upper belt assembly A is driven as described above, and the fixing belt 105 starts to rotate.

In step S16-002, a rotational force of the drive input gear G is transmitted to the pressure roll 121 of the lower belt assembly B via a drive gear train (not illustrated), so that the pressure roll 121 is driven to rotate in the counterclockwise direction indicated by an arrow in FIG. 4. In association with the rotation of the pressure roll 121, the pressure belt 120 starts to rotate by a frictional force of the rotating fixing belt 105 in the counterclockwise direction indicated by an arrow. In the fixing nip portion N, the fixing belt 105 and the pressure belt 120 move in the same direction at almost the same moving speed.

Figure 10A:
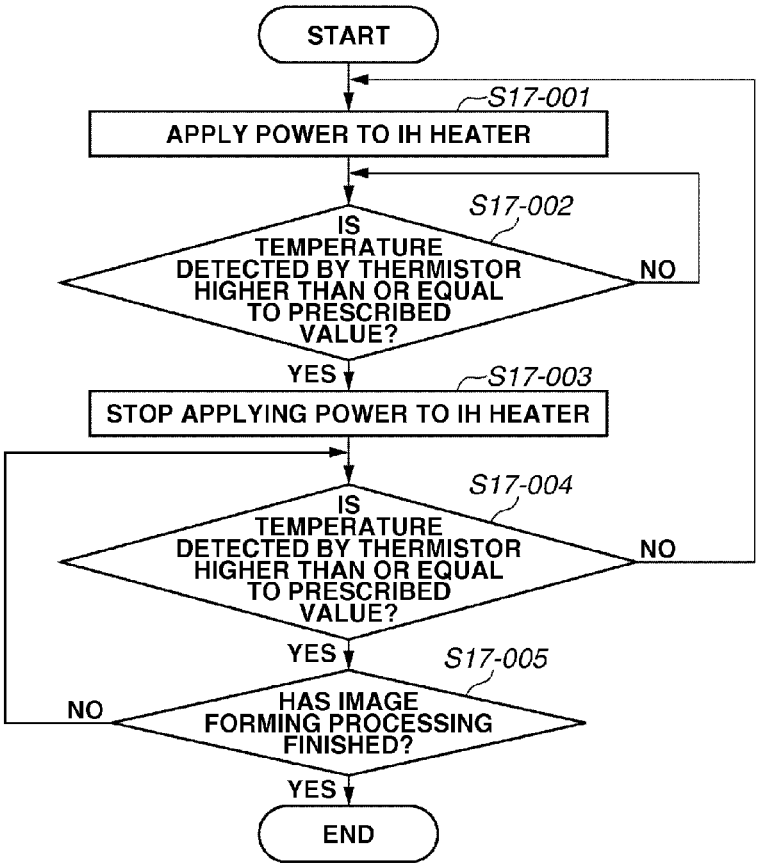
FIG. 10A is a flowchart illustrating fixing belt temperature control.
Figure 10B:
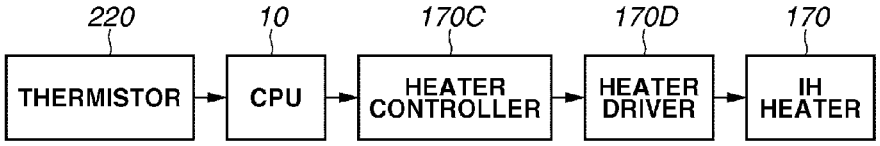
FIG. 10B is a block diagram of a control system.

Next, in step S16-003, the CPU 10 supplies power to the IH heater 170 via a heater controller 170C and a heater driver 170D (FIG. 10B). The CPU 10 thus heats the rotating fixing belt 105 by electromagnetic induction heating up to a predetermined target temperature and performs temperature adjustment control. More specifically, the CPU 10 starts the temperature adjustment control to increase and maintain the temperature of the fixing belt 105 to a target temperature of 140° C. to 200° C. (according to the present exemplary embodiment, approximately 150° C.) according to grammage and paper type of a sheet S to be passed.

After the formation of the fixing nip portion N, the rotation of the fixing belt 105 and the pressure belt 120, and the temperature increase and temperature control of the fixing belt 105, a sheet S on which the image forming units U have formed an unfixed toner image t (FIG. 4) is introduced into the fixing apparatus 100. An inlet guide 184 arranged on a sheet inlet portion of the fixing apparatus 100 guides the sheet S to enter the fixing nip portion N which is the pressure contact portion between the fixing belt 105 and the pressure belt 120. A flag sensor 185 including a photo-interrupter is arranged on the input guide 184. The flag sensor 185 detects passing timing of the sheet S.

The fixing nip portion N pinches and conveys the sheet S with the image bearing surface thereof facing the fixing belt 105 and the opposite side thereof facing the pressure belt 120. The unfixed toner image "t" is fixed to the sheet surface as a fixed image by heat and a nip pressure from the fixing belt 105. The sheet S passed through the fixing nip portion N is separated from the surface of the fixing belt 105, and comes out from the sheet outlet side of the fixing apparatus 100. The discharge roller pair 20 (FIG. 2) conveys and discharges the sheet S to the discharge tray 21.

If the conveyance of a single sheet S or a plurality of consecutive sheets S in a print job has finished, then in step S16-004, the CPU 10 ends the heating and the temperature adjustment control of the fixing belt 105 and turns off the power supply to the IH heater 170. In step S16-005, the CPU 10 turns off the drive motor 301 to stop rotating the fixing belt 105 and the pressure belt 120.

In step S16-006, the CPU 10 drives the pressure motor 302 via the motor driver 302D, so that the pressure camshaft 307 is driven to rotate by a half turn. The lower belt assembly B is moved from the pressure position illustrated in FIG. 4 to the separation position illustrated in FIG. 5. The fixing nip portion N between the fixing belt 105 and the pressure belt 120 is thus released. In such a state, the CPU 10 waits for an input of a next print job start signal.

Temperature control of the fixing belt 105 will be described with reference to a control flowchart illustrated in FIG. 10A and a block diagram of a control system illustrated in FIG. 10B. The upper belt assembly A includes a thermistor 220 which serves as a temperature detection member for detecting the surface temperature of the fixing belt 105. In step S17-001, the CPU 10 applies power to the IH heater 170 via the heater controller 170C and the heater driver 170D at predetermined control timing based on an input of a print job start signal. The IH heater 170 increases the temperature of the fixing belt 105 by electromagnetic induction heating.

The thermistor 220 detects the temperature of the fixing belt 105, and inputs detection temperature information (electrical information about temperature) to the CPU 10. In step S17-002, if the temperature detected by the thermistor 220 becomes higher than or equal to a predetermined prescribed value (target temperature) (YES in step S17-002), then in step S17-003, the CPU 10 stops the power to the IH heater 170. In step S17-004, if the temperature detected by the thermistor 220 becomes lower than the predetermined prescribed value (NO in step S17-004), then in step S17-001, the CPU 10 resumes the application of the power to the IH heater 170.

The CPU 10 repeats the above-described processing in steps S17-001 to S17-004 to adjust and maintain the temperature of the fixing belt 105 to the predetermined target temperature. Such fixing belt temperature adjustment control is performed until a print job for a predetermined single sheet or a plurality of consecutive sheets finishes (YES in step S17-005).

Belt Deviation Control Mechanism

Figure 11A:
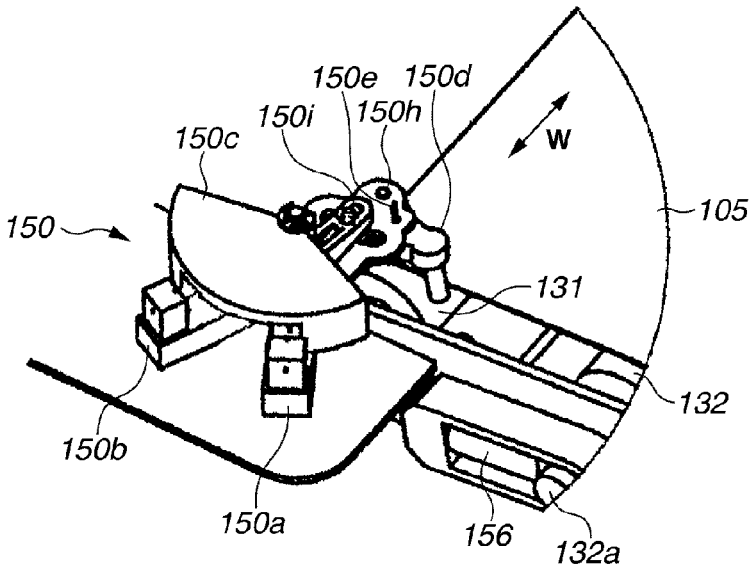
FIG. 11A illustrates a sensor unit for detecting a position of an end portion of the fixing belt.
Figure 12:
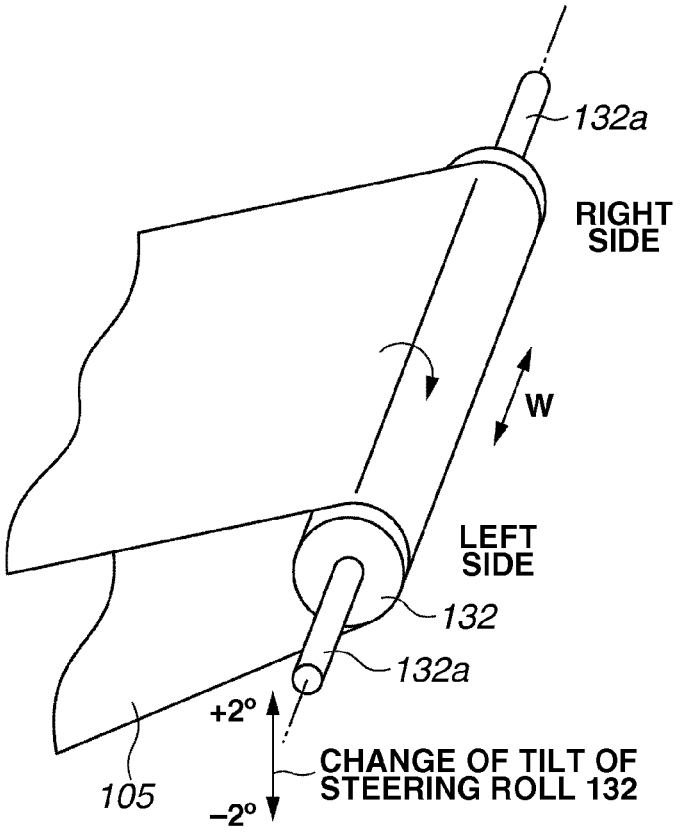
FIG. 12 illustrates tilt control of a steering roll.

During rotation, the fixing belt 105 may cause a phenomenon that the fixing belt 105 moves closer to one side or the other in the width direction W (FIGS. 1, 11A, and 12) orthogonal to the sheet conveyance direction V. Such a phenomenon will be referred to as a belt deviation movement.

According to the present exemplary embodiment, the deviation movement of the fixing belt 105 is controlled in an active manner. More specifically, swing type deviation control is performed so that the fixing belt 105 remains within a predetermined range in its longitudinal direction (width direction). Swing type deviation control refers to a method for tilting the steering roll 132 if it is detected that the fixing belt 105 moves more than a predetermined amount in the longitudinal direction (width direction), so that the fixing belt 105 moves in an opposite direction. Such swing type deviation control can be repeated to periodically move the fixing belt 105 from one side to the other in the width direction. Accordingly, the belt deviation movement can be stably controlled. In other words, the fixing belt 105 is configured to be able to reciprocate in the direction W orthogonal to the conveyance direction V of the sheet S.

The upper belt assembly A includes a sensor unit 150 (FIG. 11A) for detecting an end position of the fixing belt 105. The sensor unit 150 is arranged on the left side (near side) of the fixing belt 105. The CPU 10 detects the end position (belt deviation movement position) of the fixing belt 105 by the sensor unit 150, a detector, and changes the tilt of the steering roll 132 accordingly to perform the belt deviation control during belt rotation.

The CPU 10 detects the end position of the fixing belt 105 by the sensor unit 150. Based on the detected end position, the CPU 10 rotates the stepping motor 155, a moving mechanism, by a predetermined number of rotations in a forward direction (CW) or reverse direction (CCW). Accordingly, the left steering roll support arm 154 is rotated upward or downward about the shaft portion 131*a* by a predetermined control amount via the above-described mechanisms 157, 152, 161, and 151 illustrated in FIGS. 6 and 7. In conjunction with the rotation, the tilt of the steering roll 132 changes (FIG. 12) to perform the deviation control of the fixing belt 105.

The sensor unit 150 includes first and second, two sensors 150*a* and 150*b* and a sensor flag 150*c* which is rotatable about a shaft 150*f* in a forward direction and a reverse direction. A rotation of the sensor flag 150*c* in the forward direction or the reverse direction turns ON and OFF the first and second sensors 150*a* and 150*b* in a predetermined relationship. The sensor unit 150 further includes a sensor arm 150*d* which is rotatable about a shaft 150*h* in a forward direction and a reverse direction.

The sensor arm 150*d* is biased by a sensor spring 150*e* to rotate about the shaft 150*h* in a direction to make contact with the right end of the fixing belt 105. According to the present exemplary embodiment, the sensor spring 150*e* constantly presses the sensor arm 150*d* into contact with the lateral end of the fixing belt 105 with a force of 3 gf. Accordingly, the sensor arm 150*d* rotates about the shaft 150*h* in the forward direction or reverse direction to follow the deviation movement of the fixing belt 105.

The sensor flag 150*c* and the sensor arm 150*d* are connected by a connection mechanism 150*i* which includes a pin and a long hole. The sensor arm 150*d* thus rotates in the forward direction or reverse direction to follow the deviation movement of the fixing belt 105, and the sensor flag 150*c* rotates in the forward direction or reverse direction in conjunction with the rotation of the sensor arm 150*d*. Accordingly, the first and second sensors 150*a* and 150*b* are turned ON and OFF in a predetermined relationship. The CPU 10 detects a deviation position of the fixing belt 105 based on the combination of ON/OFF signals of the first and second sensors 150*a* and 150*b*.

Figure 11B:
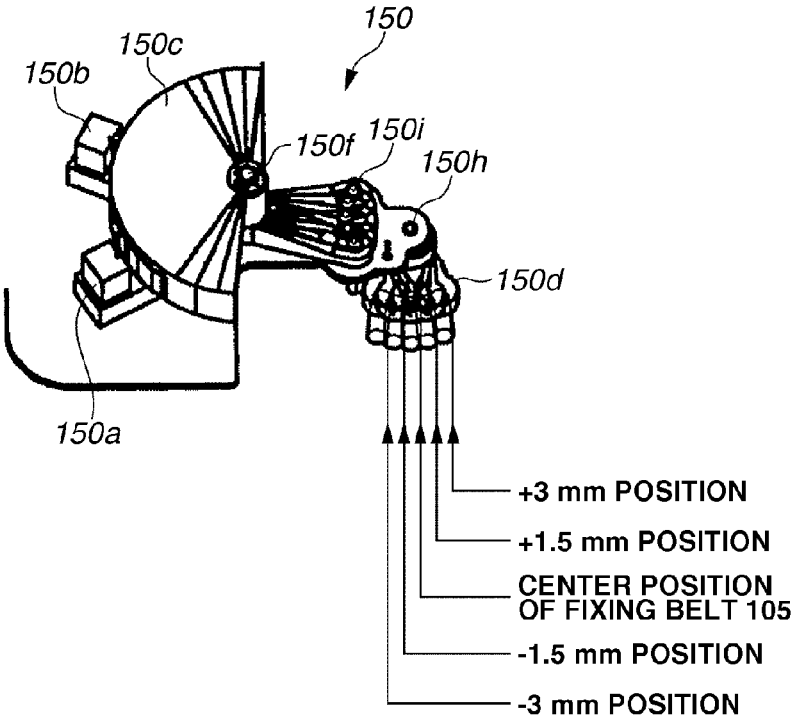
FIG. 11B illustrates combinations of ON/OFF signals of first and second sensors and corresponding positional relationships.
Figure 14A:
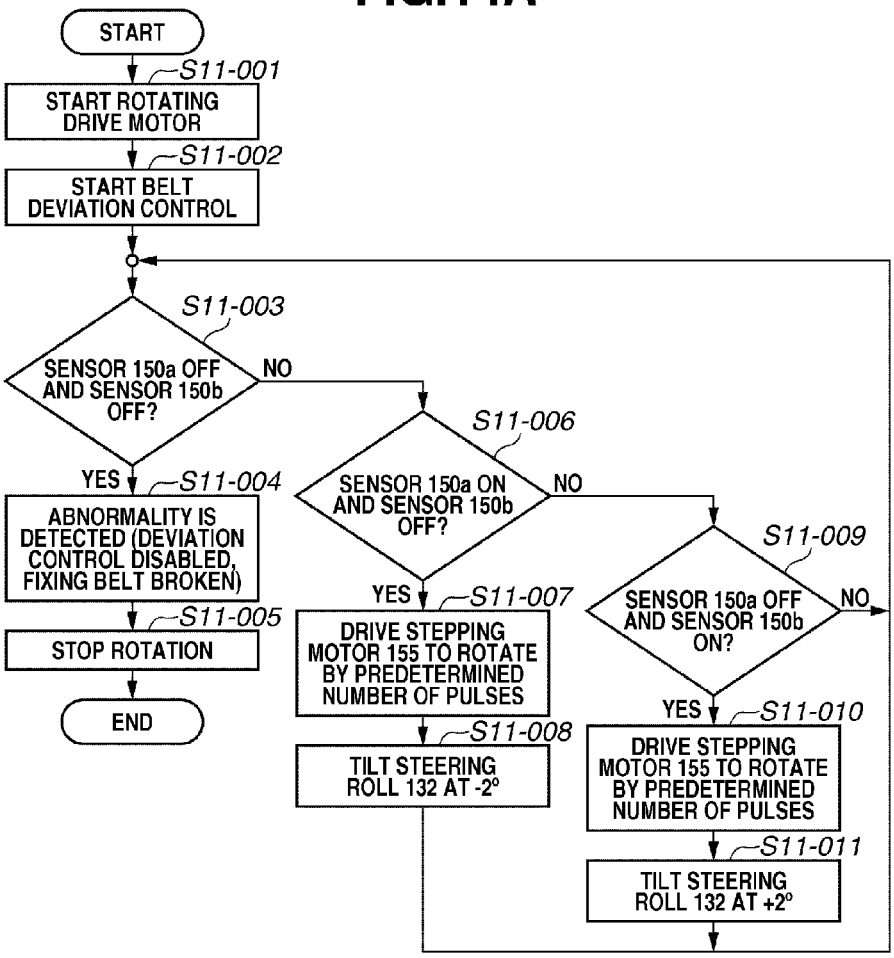
FIG. 14A is a flowchart illustrating deviation control of the fixing belt.
Figure 14B:
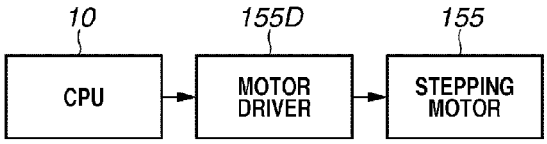
FIG. 14B is a block diagram of a control system.

FIG. 11B illustrates combinations of the ON/OFF signals of the first and second sensors 150*a* and 150*b* and corresponding positional relationships. FIG. 13 illustrates a relationship between the combination of the ON/OFF signals and the end position of the fixing belt 105. FIG. 14A illustrates a deviation control flowchart. The sensors 150*a* and 150*b* output an OFF signal when the sensor flag 150*c* blocks light. The sensors 150*a* and 150*b* output an ON signal when light is incident thereon.

As described above, the CPU 10 makes the lower belt assembly B pressed into contact with the upper belt assembly A to form the fixing nip portion N at predetermined control timing based on the input of a print job start signal. In step S11-001, the CPU 10 starts rotating the drive motor 301. Accordingly, the fixing belt 105 and the pressure belt 120 are rotated. In step S11-002, the CPU 10 starts belt deviation control upon starting to rotate the drive motor 301.

The fixing belt 105 reciprocates between a position where the first sensor 150*a* is ON and the second sensor 150*b* is OFF (YES in step S11-006) and a position where the first sensor 150*a* is OFF and the second sensor 150*b* is ON (YES in step S11-009). The CPU 10 performs swing type deviation control so that the fixing belt 105 exists within the range. The pressure belt 120 makes a deviation movement with the fixing belt 105 according to the deviation control of the fixing belt 105.

The distance of the range is ±1.5 mm from the center position in the direction of the rotational axis of the fixing belt 105. In steps S11-007 and S11-010, the CPU 10 outputs predetermined drive pulses to the stepping motor 155 via a motor drive 155D according to the position of the fixing belt 150 detected by the sensor unit 150. In steps S11-008 and S11-011, the steering roll 132 is driven by the stepping motor 155 to tilt at ±2° with respect to the drive roll 131 for deviation control.

The deviation control is disabled when the end of the fixing belt 105 comes to ±3 mm from the center position, where both the first and second sensors 150*a* and 150*b* are OFF (YES in step S11-003). In step S11-004, the CPU 10 determines that an abnormality has occurred, and brings a print operation (image forming operation) of the printer 1 to an emergency stop. As for the fixing apparatus 100, in step S11-005, the CPU 10 turns off the power supply to the IH heater 170 to stop heating the fixing belt 105, and turns off the drive motor 301 to stop rotating the fixing belt 105 and the pressure belt 120.

In addition, the CPU 10 displays the occurrence of the abnormality of the fixing apparatus 10 on a display unit of the printer operation unit 24 (FIG. 2), and prompts a user to contact a serviceperson. With a remote monitoring system, the CPU 10 may notify a service provider of the occurrence of the abnormality.

Roughening Mechanism of Fixing Belt 105

Next, a roughening mechanism (surface property recovery mechanism) for recovering a surface property of the fixing belt 105 will be described with reference to FIGS. 15A and 15B. According to the present exemplary embodiment, a roughening roller 400 is arranged above the drive roll 131 of the upper belt assembly A. The roughening roller 400 is a rubbing rotatable member which rubs the fixing belt 105 to substantially recover a surface property of the fixing belt 105. As described above, the roughening roller 400 is effective when areas of the fixing belt 105 touched by edge portions of a recording material are locally roughened as compared to other areas. More specifically, the roughening roller 400 rubs almost the entire longitudinal area of the fixing belt 105. Accordingly, the roughening roller 400 can make the areas locally roughened in the surface and the other areas approximately the same in surface roughness, so that the deteriorated state becomes less noticeable.

The roller is referred to as the "roughening roller" in the present exemplary embodiment, the role of the roughening roller is to maintain the surface roughness of the fixing belt 105 sufficiently low for a long period of time. The role of the roughening roller contributes to suppression of uneven glossiness of an image and suppression of a drop in image glossiness.

The roughening roller 400 is rotatably supported between a pair of right and left roughening (RF) support arms 141 via bearings. The right and left RF support arms 141 are rotatably supported by fixed shafts 142 which coaxially fixed to the right and left upper side plates 140 of the apparatus housing, respectively.

The roughening roller 400 includes a ϕ12-mm core of stainless steel. Abrasive grains are densely bonded to a surface of the core via an adhesive layer. Abrasive grains of #1000 to #4000 in mesh scale (granularity) can be used according to target glossiness of an image. Abrasive grains of #1000 in mesh scale have an average grain size of approximately 16 μm. Abrasive grains of #4000 in mesh scale have an average grain size of approximately 3 μm. The abrasive grains are alumina-based ones (commonly called "Alundum" or "Morundum"). Alumina grains are the most widely used in industries, and have significantly high hardness as compared to that of the surface of the fixing belt 105 and an acute-angled grain shape for excellent abrasive performance. According to the present exemplary embodiment, abrasive grains of #2000 in mesh scale (an average grain size of 7 μm) are used.

Abutting/Separating Mechanism for Abutting and Separating Roughening Roller

According to the present exemplary embodiment, the fixing apparatus 100 includes an abutting/separating mechanism for abutting and separating the roughening roller 400 against/from the fixing belt 105. The abutting/separating mechanism will be described in detailed below.

The roughening roller 400 is configured so that its shaft portions at both longitudinal ends are pressed toward the fixing belt 105 by a pressing mechanism during rubbing processing. According to the present exemplary embodiment, the right and left RF support arms 141 described below serves as the pressing mechanism.

RF cams (eccentric cams) 407 are arranged above the respective right and left RF support arms 141. The right and left RF cams 407 have the same shape and are fixed to an RF camshaft 408 with the same phase. The RF camshaft 408 is rotatably supported between the right and left upper side plates 140 of the apparatus housing via bearings. RF separation shafts 406 are fixed to the respective right and left upper side plates 140. RF separation springs 405 are stretched between arm ends of the right and left RF support arms 141 on the side opposite from where the roughening roller 400 is supported and the RF separation shafts 406, respectively.

The right and left RF support arms 141 are constantly biased by the tensile forces of the RF separation springs 405 to rotate about the respective fixed shafts 152 in a direction to lift up the roughening roller 400. Top surfaces of the right and left RF support arms 141 are elastically pressed to bottom surfaces of the corresponding right and left RF cams 407. As illustrated in FIG. 15B, an RF attachment/detachment gear 409 is fixed to a right end of the RF camshaft 408. The RF attachment/detachment gear 409 meshes with an RF motor gear 411 of an RF pressure motor 410.

According to the present exemplary embodiment, the right and left RF cams 407 are normally stopped at a first orientation of an rotational angle where large protrusions of the right and left RF cams 407 are directed upward as illustrated in FIGS. 4 and 5. In such a state, the right and left RF support arms 141 are in contact with small protrusions of the respective corresponding RF cams 407. Accordingly, the roughening roller 400 is held at a separation position in a predetermined distance away from the fixing belt 105. In other words, the roughening roller 400 is lifted above the fixing belt 105 and will not act on the fixing belt 105.

Figure 15A:
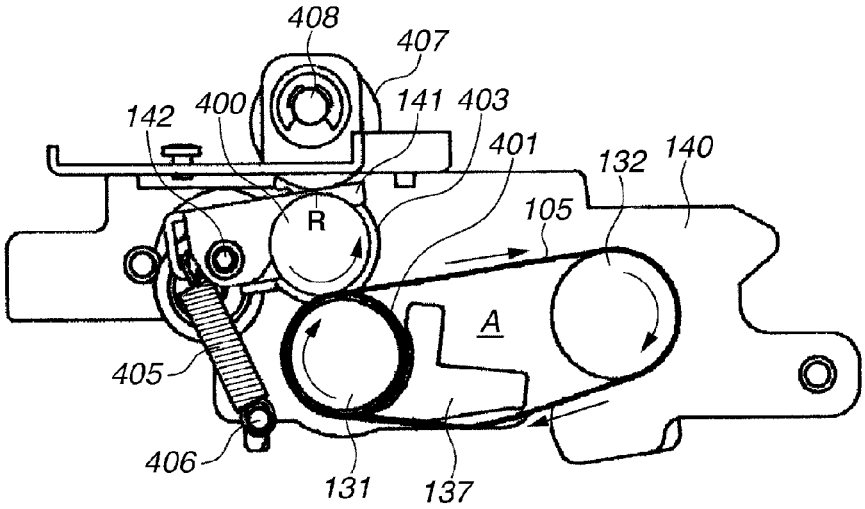
FIG. 15A is a sectional view of a roughening mechanism.
Figure 15B:
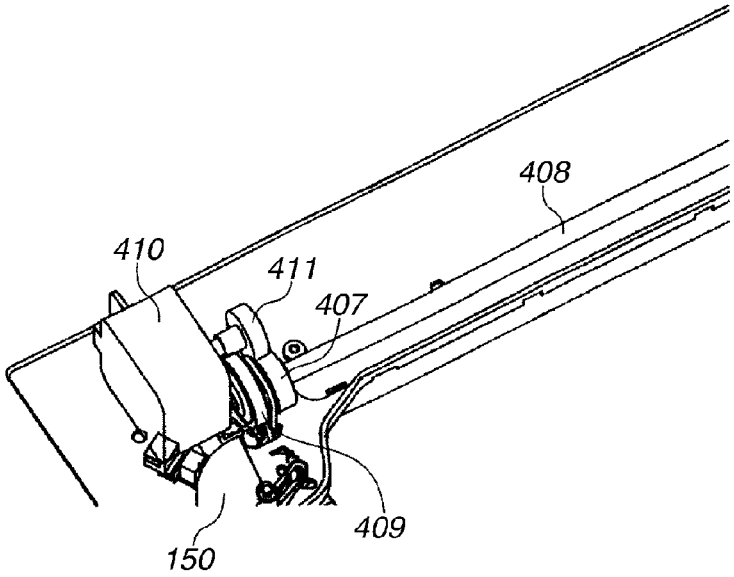
FIG. 15B is a perspective view of the roughening mechanism.

When the right and left RF cams 407 are rotated by 180° from the above-described first orientation, the right and left RF cams 407 are turned into and held in a second orientation of the rotational angle where the large protrusions are directed downward as illustrated in FIG. 15A. In such a state, the right and left RF support arms 141 are pressed down about the fixed shafts 142 by the respective corresponding RF cams 407 against the RF separation springs 405. Accordingly, the roughening roller 400 is turned into and held in a pressure position where a portion of the roughening roller 400 facing to the drive roll 131 makes contact with the surface of the fixing belt 105 with a predetermined pressing force and forms a roughening nip R.

An RF gear 403 fixed to an end of the roughening roller 400 meshes with an RF drive gear 401 fixed to an end of the drive roll 131. Accordingly, the rotational force of the drive roll 131 is transmitted to the roughening roller 400 via the RF drive gear 401 and the RF gear 403, so that the roughening roller 400 is rotated in a direction reverse to the fixing belt 105. More specifically, the roughening roller 400 having the abrasive layer on its surface has the function of rotating with a circumferential speed difference with respect to the fixing belt 105 in a "with direction" (a direction in which the surfaces both move) to evenly roughen the surface of the fixing belt 105 (a function of smoothing the surface).

In other words, the roughening roller 400 is a roller member that rotates with a circumferential speed difference with respect to the fixing belt 105. To switch the position of the roughening roller 400 between the separation position and the pressure position, the RF pressure motor 410 switches the orientation of the right and left RF cams 407 between the first orientation and the second orientation via the RF motor gear 411, the RF attachment/detachment gear 409, and the RF camshaft 408. In FIG. 15A, the illustration of the lower belt assembly B which is pressed against the upper belt assembly A to form the fixing nip portion N is omitted.

Figure 16A:
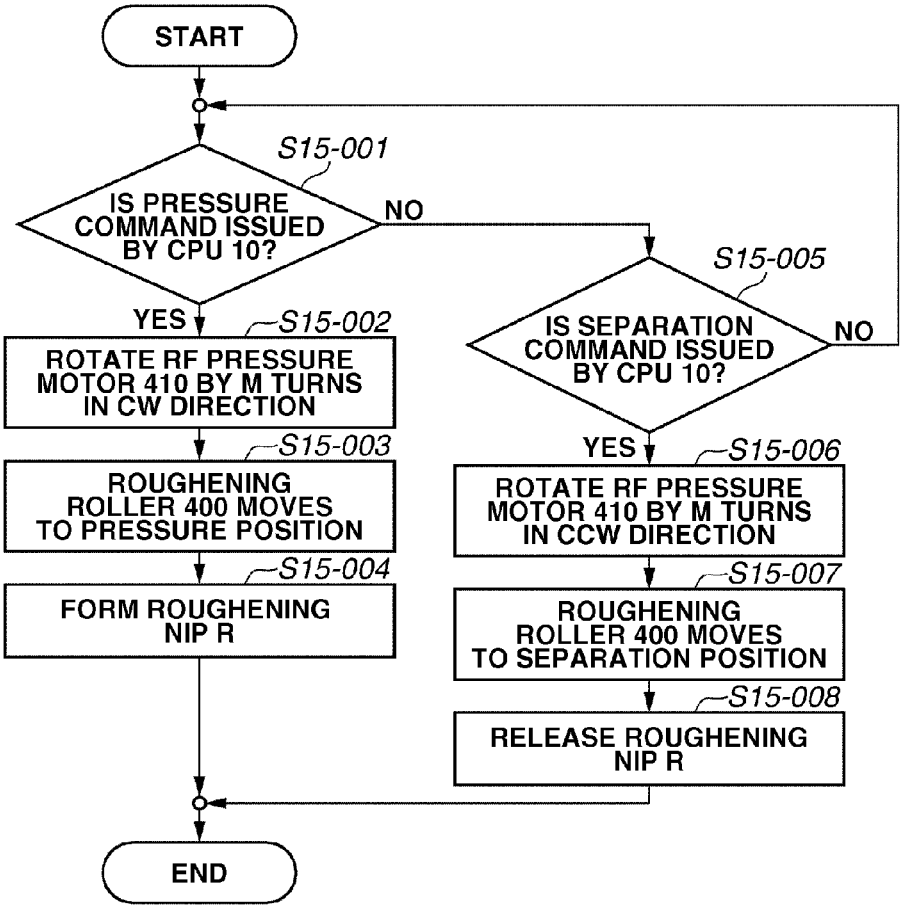
FIG. 16A is a flowchart illustrating control of the roughening mechanism.
Figure 16B:
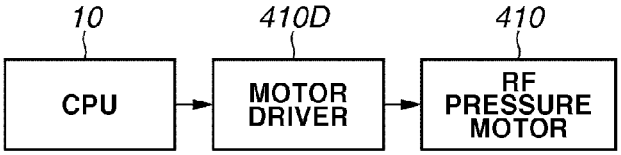
FIG. 16B is a block diagram of a control system.

FIG. 16A is an operation control flowchart of the above-described roughening mechanism. FIG. 16B is a block diagram of a control system. As described above, the right and left RF cams 407 of the roughening mechanism are normally stopped at the first orientation of the rotational angle where the large protrusions are directed upward as illustrated in FIGS. 4 and 5. In other words, the roughening roller 400 is held in the separation position at a predetermined distance from the fixing belt 105.

In step S15-001, if the CPU 10, a controller, issues a pressure command at predetermined pressure control timing (YES in step S15-001), then in step S15-002, the CPU 10 rotates the RF pressure motor 410 by a predetermined number of rotations, or M turns, in the CW direction via a motor driver 410D. In step S15-003, the right and left RF cams 704 are switched from the first orientation (FIGS. 4 and 5) to the second orientation (FIG. 15A), so that the roughening roller 400 is moved from the separation position to the pressure position. In step S15-004, with the roughening roller 400 moved to the pressure position, the fixing belt 105 and the roughening roller 400 are pressed against each other to form the roughening nip R.

In step S15-005, if the CPU 10 issues a separation command at predetermined separation control timing (YES in step S15-005), then in step S15-006, the CPU 10 rotates the RF pressure motor 410 by a predetermined number of rotations, or M turns, in the CCW direction via the motor driver 410D. In step S15-007, the right and left RF cams 407 are switched back from the second orientation (FIG. 15A) to the first orientation (FIGS. 4 and 5), so that the roughening roller 400 is moved from the pressure position to the separation position. In step S15-008, with the roughening roller 400 moved to the separation position, the fixing belt 105 and the roughening roller 400 are separated to release the roughening nip R.

Next, a positional relationship between the roughening roller 400 and a rubbing area of fixing belt 105 rubbed by the roughening roller 400 will be described with reference to FIG. 1.

As described above, the fixing belt 105 is configured to reciprocate by a width of ±1.5 mm in the W direction (direction orthogonal to the conveyance direction V) of the sheet S with reference to the center in the W direction. A width Z in the longitudinal direction of the rubbing area where the fixing belt 105 can be rubbed by the roughening roller 400 is given by X+3 mm, where X is a width of the roughening roller 400 in the longitudinal direction (a width of an effective area excluding the shaft portions at both longitudinal ends).

To prevent an image abnormality from occurring on a sheet S due to deterioration of the surface of the fixing belt 105, the present exemplary embodiment employs the following setting. The width Z of the rubbing area of the fixing belt 105 is set to coincide with a width Y of a sheet S having a maximum width usable in the fixing apparatus 100 (330.2 mm (13 inches)).

Since the width Z of the rubbing area of the fixing belt 105 may be set to be greater than or equal to the width Y of the sheet S having the maximum width usable in the fixing apparatus 100, the following relationship can be satisfied:

The width $X$ of the roughening roller 400<the width $Y$ of the sheet $S$<the width $Z$ of the rubbing area of the fixing belt 105.

The length of the roughening roller 400 and the amount of movement of the fixing belt 105 by the deviation control are set to satisfy such a relationship. More specifically, according to the present exemplary embodiment, the amount of movement of the fixing belt 105 by the deviation control is set to ±1.5 mm. The length of the roughening roller 400 is set to 328 mm.

According to the above-described configuration, the longitudinal width X of the roughening roller 400 can be made smaller than the width Y of the sheet S. Given the same contact pressure at the longitudinal center of the roughening nip R, the present exemplary embodiment can reduce the contact pressure at both ends of the roughening roller 400 by approximately 18% as compared to when a surface property recovery guarantee width (the width of the sheet S) Y and the width X of the roughening roller 400 are the same.

According to the present exemplary embodiment, the above-described simple configuration can reduce the contact pressure of the roughening roller 400, and provide the effect of suppressing the occurrence of such phenomena as excessive wear, cracks, and creases of the tube at the surface layer of the fixing belt 105.

According to the present exemplary embodiment, the surface property recovery guarantee width Y is set to the width of a sheet S having the maximum width usable in the fixing apparatus 100. However, the surface property recovery guarantee width Y may be set to the width of an area where an image can be formed or that of an area where an image is guaranteed by specifications. More specifically, the surface property recovery guarantee width Y may be set to an effective development width F of a developing roller 5A (FIG. 1) which is a developing member for developing an image to form a toner image. Such a setting can further reduce the contact pressure. In other words, the width X of the roughening roller 400 may be configured to be smaller than the effective development width F of the developing roller 5A, the developing member which forms an image for the sheet S to bear. The width Z of the surface property recovery area may be the same as or greater than the effective development width F.

In addition, the width X of the roughening roller 400 may be configured to be smaller than a width E (FIG. 1) of an image having a maximum width that can be formed on a sheet S having the maximum width (Y) usable in the fixing apparatus 100. The width Z of the surface property recovery area may be the same as or greater than the width E of the image.

Next, timing to enter a surface property recovery operation of the fixing belt 105 by the roughening roller 400 will be described. According to the present exemplary embodiment, the CPU 10, the controller, uses a counter C (see a block diagram in FIG. 17B) to count the number of sheets S on which the fixing apparatus 100 has performed the fixing processing while executing a print job, and stores the integrated value.

If the counter C counts a predetermined number N of passed sheets (integral threshold), the CPU 10 performs the surface property recovery operation of the fixing belt 105 by the roughening roller 400 after the print job in process finishes or by suspending the execution of the print job. The CPU 10 resets the counter C to zero. If the print job is suspended, the CPU 10 resumes the remaining print job after the execution of the surface property recovery operation of the fixing belt 105.

Figure 17A:
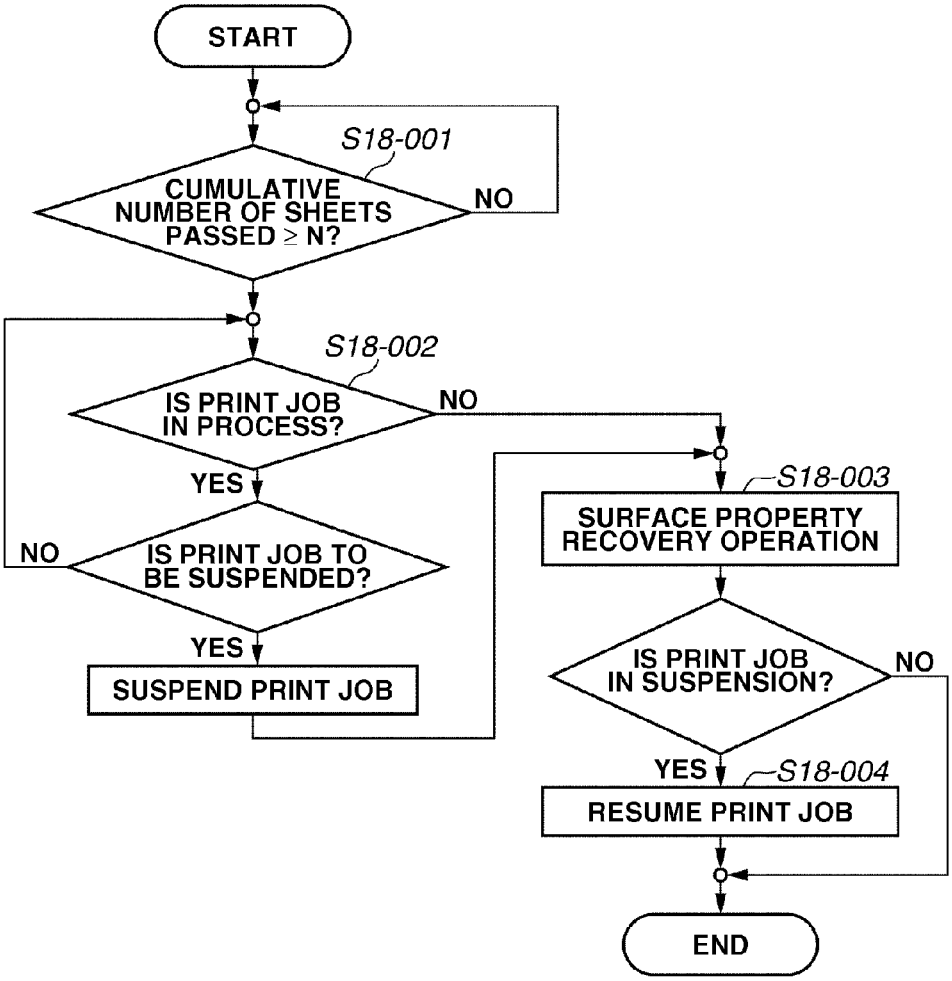
FIG. 17A is a flowchart illustrating control of the roughening mechanism.
Figure 17B:
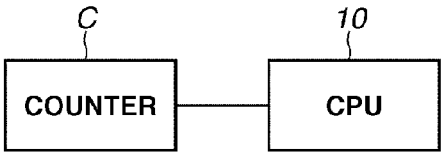
FIG. 17B is a block diagram of a control system.

FIG. 17A is a flowchart illustrating the above-described surface property recovery operation. In step S18-001, if the integrated value of sheets passed is greater than or equal to the predetermined number of passed sheets N (YES in step S18-001), then in step S18-002, the CPU 10 finishes or suspends the print job in process. In step S18-003, the CPU 10 starts the surface property recovery operation. The CPU 10 resets the counter C to zero. After the end of the surface property recovery operation, the CPU 10 enters a wait for a next print job. In a case where the print job has been suspended, then in step S18-004, the CPU 10 resumes the suspended print job, and enters a wait for a next print job after the end of the print job.

The present exemplary embodiment deals with the case of entering the surface property recovery operation of the fixing belt 105 by the roughening roller 400 when the number of sheets on which the fixing processing has been performed reaches the predetermined number of sheets. However, the present exemplary embodiment is not limited to this setting. The CPU 10 may only count the number of specific sheets on which the fixed processing has been performed. The CPU 10 may perform the surface property recovery operation of the fixing belt 105 on a timely basis like before a print job for a certain type of sheet or when a user makes an operation on the printer operation unit 24 (FIG. 2) during a print standby state.

Figure 18:
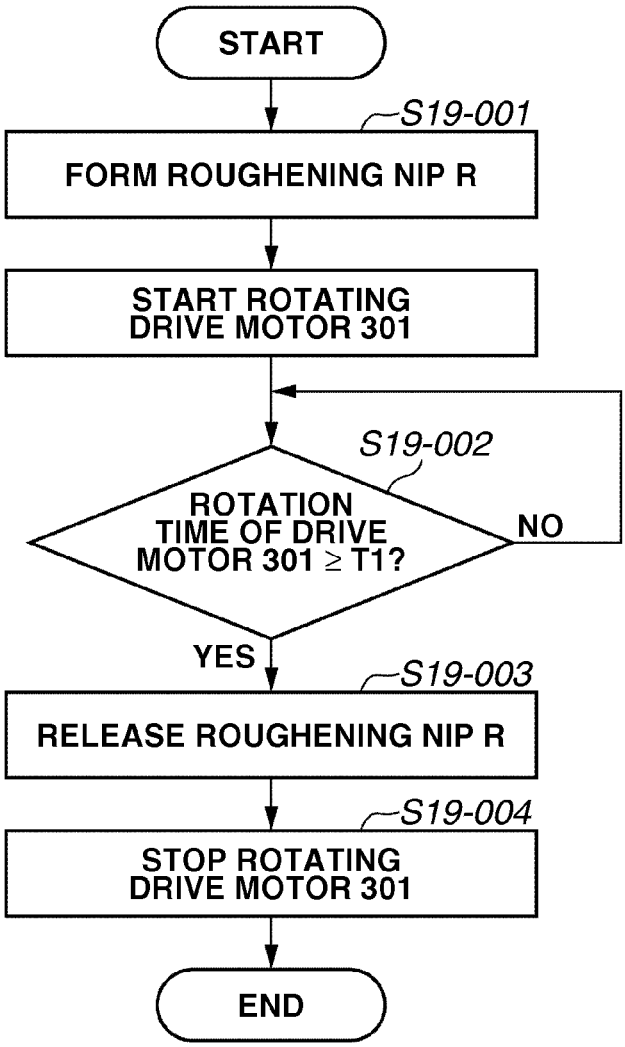
FIG. 18 is a flowchart illustrating a surface property recovery operation flow.
Figure 19A:
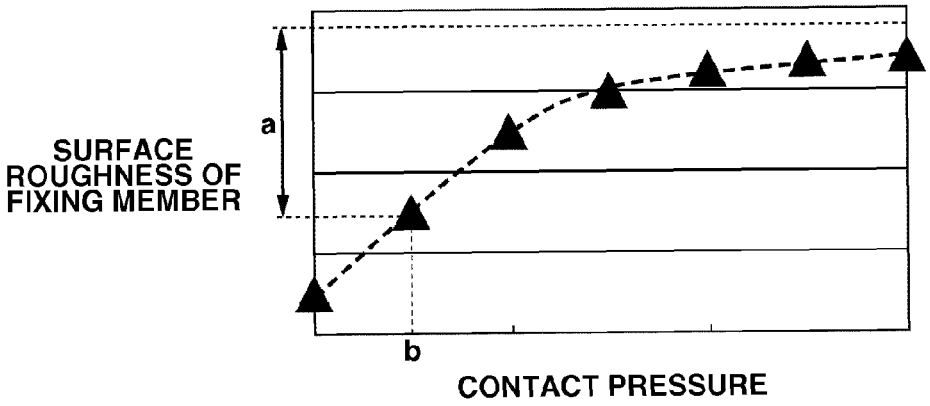
FIG. 19A is a graph illustrating a relationship between a surface roughness of the fixing member and a contact pressure between the roughening roller and the fixing member.
Figure 19B:
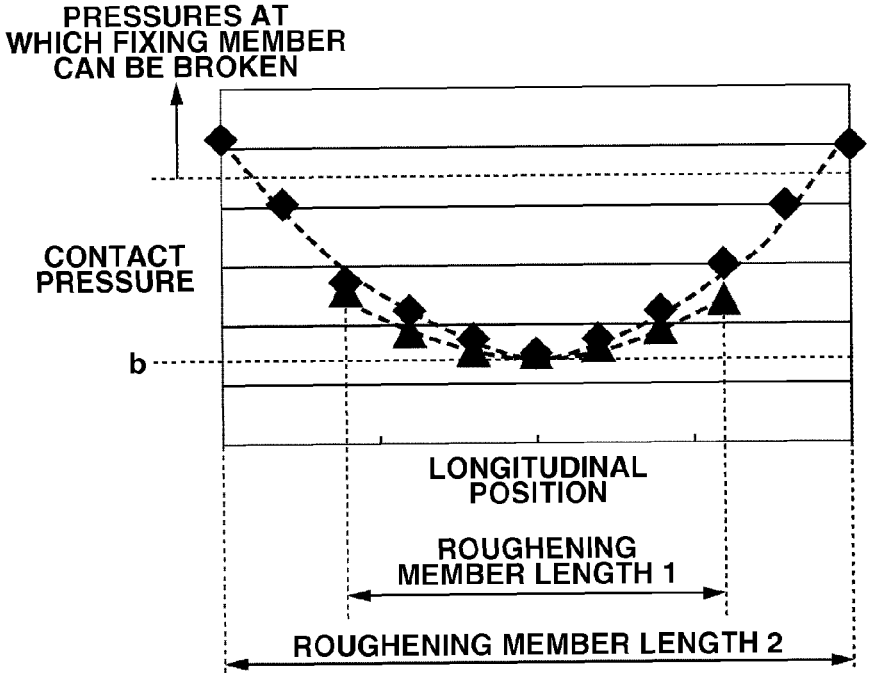
FIG. 19B is a graph illustrating a distribution of the contact pressure in a longitudinal direction of the fixing member.

Next, the surface property recovery operation of the fixing belt 105 will be described in detail with reference to FIG. 18. In step S19-001, the CPU 10 moves the roughening roller 400 to the pressure position to form the roughening nip R with the fixing belt 105.

In step S19-002, the CPU 10 turns on the drive motor 301 to rotate for a predetermined time T1. In other words, the CPU 10 rotates the fixing belt 105 for the predetermined time T1. Suppose that the surface of the fixing belt 105 is roughened to a surface roughness Rz of approximately 2.0 by sheets S having a grammage of approximately 220 gsm. Such a surface is recovered to Rz of 0.5 to 1.0 in the predetermined time T1.

In step S19-003, after the lapse of the predetermined time T1, the CPU 10 moves the roughening roller 40 to the separation position to release the roughening nip R on the fixing belt 105. In step S19-004, the CPU 10 stops rotating the drive motor 301 to end the surface property recovery operation of the fixing belt 105.

If the time needed for the fixing belt 105 to make one rotation is equal to the time needed for the fixing belt 105 to make one reciprocation by the deviation control, some areas of the belt surface is left untouched by the roughening roller 400. If the time needed for the fixing belt 105 to make one reciprocation by the deviation control is shorter than the time needed for the fixing belt 105 to make one rotation, the rubbing of the fixing belt 105 with the roughening roller 400 can become dominant in the direction X orthogonal to the conveyance direction V of the sheet S.

According to the present exemplary embodiment, the CPU 10 therefore performs steering control of the fixing belt 105 so that the time needed for the fixing belt 105 to make one rotation becomes shorter than the time needed for the fixing belt 105 to make one reciprocation by the deviation control. More specifically, the time needed for the fixing belt 105 to make one rotation is 5 seconds, and the time needed for the fixing belt 105 to make one reciprocation by the deviation control is 15 to 45 seconds. In other words, the time needed for the fixing belt 105 to make a reciprocation by the deviation control is longer than the time needed for the fixing belt 105 to make one rotation.

Other Remarks

The above description deals with the case where the roughening roller rubs the fixing belt. However, the present exemplary embodiment is not limited to this configuration. With a reciprocating configuration, similar effects can be provided if the fixing member may be a roller-like member.

The above description deals with the case where the fixing member is reciprocated by the deviation control mechanism. However, as long as the positions of the fixing member and the roughening roller in the longitudinal direction can be changed relatively, the configuration is not limited to the one in the above-described exemplary embodiment.

The pressure member (nip forming member) need not be a rotatable member. A non-rotatable member may be used, like a pad or a plate-like member that has a low friction coefficient at the surface, i.e., contact surface with the rotatable fixing member and recording material.

The above description deals with the fixing apparatus which fixes an unfixed toner image to a sheet S. The exemplary embodiment of the present invention may be applicable to, for example, an apparatus that heats and presses an image once fixed or temporarily fixed to a sheet S again for improved glossiness.

The heating mechanism is not limited to electromagnetic induction heating. Other heating mechanisms such as a halogen heater may be used.

The image forming process of the image forming apparatus is not limited to the electrophotographic method. An electrostatic recording method and a magnetic recording method may also be used.

While the present invention has been described with reference to exemplary embodiments, it is to be understood that the disclosure is not limited to the disclosed exemplary embodiments. The scope of the following claims is to be accorded the broadest interpretation so as to encompass all modifications, equivalent structures, and functions.

This application claims priority from Japanese Patent Application No. 2012-087253 filed Apr. 6, 2012, which is hereby incorporated by reference herein in its entirety.

What is claimed is:

1. A fixing apparatus comprising:

first and second fixing rotatable members configured to fix a toner image on a sheet at a nip portion therebetween;

a rubbing rotatable member configured to rub the first fixing rotatable member; and a moving mechanism configured to cause the first fixing rotatable member to reciprocate with respect to a sheet passage area in a longitudinal direction of the first fixing rotatable member, wherein a relationship $X<Y\leq Z$ is satisfied, where X is a width of the rubbing rotatable member in the longitudinal direction, Y is a width, in the longitudinal direction, of a maximum area where an image is able to be formed on a sheet having a maximum width usable in the fixing apparatus, and Z is a width, in the longitudinal direction, of an area where the first fixing rotatable member is able to be rubbed by the rubbing rotatable member as the first fixing rotatable member reciprocates.

2. The fixing apparatus according to claim 1, further comprising:

an abutting/separating mechanism configured to abut and separate the rubbing rotatable member against/from the first fixing rotatable member;

a counter configured to count the number of sheets passed; and a controller configured to control an operation of the abutting/separating mechanism according to an output of the counter.

3. The fixing apparatus according to claim 2, wherein the controller is configured to control the abutting/separating mechanism so that a rubbing processing by the rubbing rotatable member is performed when a fixing processing is not performed.

4. The fixing apparatus according to claim 3, wherein the controller is configured to control the abutting/separating mechanism so the rubbing rotatable member is separated from the first fixing rotatable member when the fixing processing is performed.

5. The fixing apparatus according to claim 1, wherein the width Y coincides with a width of the sheet having the maximum width.

6. The fixing apparatus according to claim 1, wherein the rubbing rotatable member is arranged so a center of the width X in the longitudinal direction substantially coincides with a center of the width Y in the longitudinal direction, and wherein the moving mechanism causes the first fixing rotatable member to reciprocate with reference to a position substantially coincident with the center of the width Y in the longitudinal direction.

7. The fixing apparatus according to claim 1, further comprising a detector configured to detect a position of the first fixing rotatable member in the longitudinal direction, wherein the moving mechanism causes the first fixing rotatable member to reciprocate according to an output of the detector.

8. The fixing apparatus according to claim 1, wherein the rubbing rotatable member is configured to have abrasive grains in a range of #1000 to #4000 in mesh scale bonded to a surface thereof.

9. The fixing apparatus according to claim 1, wherein the rubbing rotatable member is configured to perform rubbing processing so that the first fixing rotatable member has a surface roughness (Rz) of 0.5 to 1.0.

10. The fixing apparatus according to claim 1, further comprising a pressing mechanism configured to press shaft portions located at both ends of the rubbing rotatable member in the longitudinal direction toward the first fixing rotatable member.

11. A fixing apparatus comprising:

an endless belt configured to heat a toner image on a sheet at a nip portion;

a nip forming member configured to form the nip portion cooperatively with the endless belt;

a rubbing rotatable member configured to rub the endless belt;

a detector configured to detect a position of the endless belt in a longitudinal direction; and a moving mechanism configured to cause the endless belt to reciprocate in the longitudinal direction according to an output of the detector, wherein a relationship $X<Y\leq Z$ is satisfied, where X is a width of the rubbing rotatable member in the longitudinal direction, Y is a width, in the longitudinal direction, of a maximum area where an image is able to be formed on a sheet having a maximum width usable in the fixing apparatus, and Z is a width, in the longitudinal direction, of an area where the endless belt is able to be rubbed by the rubbing rotatable member as the endless belt reciprocates.

12. The fixing apparatus according to claim 11, further comprising:

an abutting/separating mechanism configured to abut and separate the rubbing rotatable member against/from the endless belt;

a counter configured to count a number of sheets passed; and a controller configured to control an operation of the abutting/separating mechanism according to an output of the counter.

13. The fixing apparatus according to claim 12, wherein the controller is configured to control the abutting/separating mechanism so that a rubbing processing by the rubbing rotatable member is performed when a fixing processing is not performed.

14. The fixing apparatus according to claim 13, wherein the controller is configured to control the abutting/separating mechanism so the rubbing rotatable member is separated from the endless belt when the fixing processing is performed.

15. The fixing apparatus according to claim 11, wherein the width Y coincides with a width of the sheet having the maximum width.

16. The fixing apparatus according to claim 11, wherein the rubbing rotatable member is arranged so a center of the width X in the longitudinal direction substantially coincides with a center of the width Y in the longitudinal direction, and wherein the moving mechanism causes the first fixing rotatable member to reciprocate with reference to a position substantially coincident with the center of the width Y in the longitudinal direction.

17. The fixing apparatus according to claim 11, wherein the rubbing rotatable member is configured to have abrasive grains in a range of #1000 to #4000 in mesh scale bonded to a surface thereof.

18. The fixing apparatus according to claim 11, wherein the rubbing rotatable member is configured to perform rubbing processing so that the endless belt has a surface roughness (Rz) of 0.5 to 1.0.

19. The fixing apparatus according to claim 11, further comprising a support roller configured to rotatably support an inner surface of the endless belt, wherein the rubbing rotatable member is configured to make contact with an outer surface of an area of the endless belt supported by the support roller and perform rubbing processing.

20. The fixing apparatus according to claim 11, further comprising a pressing mechanism configured to press shaft portions located at both ends of the rubbing rotatable member in the longitudinal direction toward the endless belt.

* * * * *